US012178384B2

(12) United States Patent
Arora et al.

(10) Patent No.: US 12,178,384 B2
(45) Date of Patent: Dec. 31, 2024

(54) BRUSH FOR AUTONOMOUS CLEANING ROBOT

(71) Applicant: iRobot Corporation, Bedford, MA (US)

(72) Inventors: Shipra Arora, Cambridge, MA (US); Philip Petrides, Boston, MA (US); Lauren D. Stern, Medford, MA (US)

(73) Assignee: iRobot Corporation, Bedford, MA (US)

( * ) Notice: Subject to any disclaimer, the term of this patent is extended or adjusted under 35 U.S.C. 154(b) by 612 days.

(21) Appl. No.: 17/345,585

(22) Filed: Jun. 11, 2021

(65) Prior Publication Data

US 2022/0395154 A1 Dec. 15, 2022

(51) Int. Cl.

| | |
|---|---|
| ***A47L 9/04*** | (2006.01) |
| ***A46B 7/04*** | (2006.01) |
| ***A46B 9/02*** | (2006.01) |
| ***A46B 13/00*** | (2006.01) |
| ***A46B 13/02*** | (2006.01) |
| ***A46B 15/00*** | (2006.01) |
| ***A47L 9/10*** | (2006.01) |
| ***A47L 9/28*** | (2006.01) |

(52) U.S. Cl.

CPC ..... *A47L 9/0488* (2013.01); *A46B 7/04* (2013.01); *A46B 9/026* (2013.01); *A46B 13/001* (2013.01); *A46B 13/008* (2013.01); *A46B 13/02* (2013.01); *A46B 15/0053* (2013.01); *A47L 9/0472* (2013.01); *A47L 9/0477* (2013.01); *A47L 9/10* (2013.01); *A47L 9/2852* (2013.01); *A46B 2200/3033* (2013.01); *A47L 2201/04* (2013.01)

(58) Field of Classification Search

CPC ..... A47L 2201/00

See application file for complete search history.

(56) References Cited

U.S. PATENT DOCUMENTS

| | | | | |
|---|---|---|---|---|
| 6,643,894 | B1 * | 11/2003 | Dell | A47L 9/02 15/385 |
| 8,869,342 | B2 | 10/2014 | Yoon et al. | |
| 2004/0255783 | A1 * | 12/2004 | Graham | B01D 46/10 55/528 |
| 2008/0276408 | A1 | 11/2008 | Gilbert et al. | |
| 2013/0152332 | A1 | 6/2013 | Jang | |
| 2016/0143496 | A1 | 5/2016 | Penner | |
| 2016/0166127 | A1 | 6/2016 | Lewis | |
| 2017/0354303 | A1 | 12/2017 | Kastensson et al. | |
| 2018/0177368 | A1 * | 6/2018 | Acker | A47L 9/1683 |
| 2020/0060488 | A1 * | 2/2020 | McRorie | A47L 9/0477 |

FOREIGN PATENT DOCUMENTS

| | | | | |
|---|---|---|---|---|
| EP | 3420873 | A1 * | 1/2019 | A47L 11/40 |
| TW | M527298 | | 8/2016 | |

* cited by examiner

*Primary Examiner* — Andrew A Horton

(74) *Attorney, Agent, or Firm* — Fish & Richardson P.C.

(57) ABSTRACT

An autonomous cleaning robot includes a drive system to move the autonomous cleaning robot about a floor surface, a cleaning head on a bottom portion of the autonomous cleaning robot, a side brush on the bottom portion of the autonomous cleaning robot, and a vacuum system in pneumatic communication with the opening. The cleaning head is configured to direct debris from the floor surface into the autonomous cleaning robot as the autonomous cleaning robot moves about the floor surface. The side brush is rotatable about a rotational axis forming a non-zero angle with a floor surface, and the side brush comprising an opening.

23 Claims, 16 Drawing Sheets

BRUSH FOR AUTONOMOUS CLEANING ROBOT

TECHNICAL FIELD

This specification relates to a brush for an autonomous cleaning robot.

BACKGROUND

An autonomous cleaning robot can clean a floor surface as it moves across a floor surface. The robot can include a vacuum and a side brush to manipulate debris and assist in the collection of the debris by the vacuum. For example, a side brush can sweep debris into the airstream of the vacuum so the dust can more easily be collected by the robot.

SUMMARY

This disclosure describes technologies relating to autonomous cleaning robots and different designs of auxiliary or side brushes for an autonomous cleaning robot that are operable to direct debris toward a cleaning inlet of the robot. The robot can remove debris on a floor surface through the cleaning inlet of the robot and collect this debris in a cleaning bin of the robot. The robot can include a brush, e.g., an auxiliary or side brush, that can reach debris beyond a perimeter of the robot. The side brush can contact the floor surface and then, as the side brush rotates, guide the debris toward the cleaning inlet of the robot to allow the robot to draw debris into the cleaning bin of the robot.

This disclosure provides several different examples of side brushes that can improve cleaning efficiency. In some examples, the side brushes include bristles of varying lengths that form spaces to capture and maintain contact with debris to guide the debris toward the cleaning inlet. In further examples, the side brushes may use curved blades to scoop and maintain contact with debris as the curved blades move the debris toward the cleaning inlet. And in further examples, the side brushes are vacuum-enabled, allowing the robot to generate inward or outward-directed airflows to draw debris toward the robot or to disperse debris on the floor surface.

In one aspect, a side brush for an autonomous cleaning robot movable about a floor surface includes a hub rotatably mountable to the autonomous cleaning robot such that the side brush is rotatable about a rotational axis forming a non-zero angle with the floor surface. The side brush further includes a bristle bundle attached to the hub. The bristle bundle includes a first set of bristles having a distal tip at a first distance from a center of the side brush and a second set of bristles having a distal tip at a second distance from the center of the side brush, the second distance being less than the first distance.

In another aspect, an autonomous cleaning robot includes a drive system to move the autonomous cleaning robot about a floor surface, a vacuum inlet on a bottom portion of the autonomous cleaning robot and configured to face the floor surface, and a side brush. The side brush includes a hub rotatably mountable to the autonomous cleaning robot such that the side brush is rotatable about a rotational axis forming a non-zero angle with the floor surface. The side brush further includes a bristle bundle attached to the hub. The bristle bundle includes a first set of bristles having a distal tip at a first distance from a center of the side brush and a second set of bristles having a distal tip at a second distance from the center of the side brush, the second distance being less than the first distance. The side brush is rotatable to retrieve debris on the floor surface and move the debris to from a first position to a second position, the first position being farther from the vacuum inlet than the second position.

Implementations for these aspects can include one or more of the features described below and described elsewhere in this disclosure.

In some implementations, the bristle bundle can include a third set of bristles having a distal tip at a third distance from the center of the side brush. The third distance can be less than the first distance. The first set of bristles can be positioned between the second set of bristles and the third set of bristles.

In some implementations, the side brush can further include an arm extending from the hub, the arm attaching the bristle bundle to the hub. The bristle bundle can extend from a distal end of the arm to the distal tip of the first set of bristles and the distal tip of the second set of bristles.

In some implementations, the arm and the first set of bristles can extend along a radial axis extending from the rotational axis of the side brush, and at least a portion of the second set of bristles can extend along an axis angled relative to radial axis. In some implementations, the side brush further includes a plurality of bristle bundles comprising the bristle bundle, and a plurality of arms comprising the arm. The plurality of arms can be joined to the hub at locations along the hub that are spaced apart from one another.

In some implementations, the plurality of arms can include at least four arms, and the plurality of bristle bundles can include at least four bristle bundles. Each of the at least four bristle bundles can extend from a corresponding distal end of a corresponding arm of the at least four arms.

In some implementations, the first set of bristles can extend along a radial axis extending from the rotational axis of the side brush, and the second set of bristles can surround the first set of bristles in a transverse cross-section across the radial axis.

In some implementations, a second quantity of bristles in the second set of bristles can be less than a first quantity of bristles in the first set of bristles. In some implementations, the first quantity can be 25% to 200% more than the second quantity.

In some implementations, bristles of the first set of bristles can be formed of a first material, and bristles of the second set of bristles can be formed of a second material. The first material can be less stiff than the second material.

In some implementations, the first distance can be 25% to 75% greater than the second distance.

In some implementations, the first set of bristles and the second set of bristles can define a space for retrieving debris from the floor surface.

In some implementations, the hub can be mountable to the autonomous cleaning robot such that the non-zero angle is between 70 and 90 degrees.

In some implementations, the autonomous cleaning robot can include a roller on the bottom portion of the autonomous cleaning robot, the roller adjacent to the vacuum inlet and rotatable about an axis parallel to the floor surface.

In another aspect, a side brush for an autonomous cleaning robot movable about a floor surface includes a hub rotatably mountable to the autonomous cleaning robot such that the side brush is rotatable in a direction of rotation about a rotational axis forming a non-zero angle with the floor surface, and a blade attached to the hub. The blade extends from a proximal end attached to the hub to a distal end and includes a concave surface between the proximal end of the blade and the distal end of the blade. The concave surface faces the direction of rotation.

In another aspect, an autonomous cleaning robot includes a drive system to move the autonomous cleaning robot about a floor surface, a vacuum inlet on a bottom portion of the autonomous cleaning robot and configured to face the floor surface, and a side brush. The side brush includes a hub rotatably mountable to the autonomous cleaning robot such that the side brush is rotatable in a direction of rotation about a rotational axis forming a non-zero angle with the floor surface, and a blade attached to the hub. The blade extends from a proximal end attached to the hub to a distal end and includes a concave surface between the proximal end of the blade and the distal end of the blade. The concave surface faces the direction of rotation. The side brush is rotatable to retrieve debris on the floor surface and move the debris to from a first position to a second position. The first position is farther from the vacuum inlet than the second position.

Implementations for these aspects can include one or more of the features described below and described elsewhere in this disclosure.

In some implementations, the concave surface can extend from the proximal end of the blade to the distal end of the blade along a radial axis extending through the rotational axis.

In some implementations, the blade can include a lower edge and an upper edge. The concave surface can be positioned between the lower edge and the upper edge. In some implementations, the lower edge can extend from a first end attached to the hub to a second end. An axis extending through the first end and the second end of the lower edge can form an angle between 80 and 90 degrees with the rotational axis of the side brush. In some implementations, the lower edge can include a concave portion facing the direction of rotation. In some implementations, the blade can include a first material forming at least part of the concave surface and a second material forming at least part of the lower edge. In some implementations, the blade can include bristles extending as part of the lower edge. In some implementations, the upper edge can extend from a first end attached to the hub to a second end. The distance along the rotational axis between the second end and first end of the upper edge can be between 0.1 and 2 centimeters.

In some implementations, the blade can taper inward from the distal end to the proximal end.

In some implementations, the side brush can further include a plurality of blades attached to the hub. The blade can correspond to a first of the plurality of blades. In some implementations, the plurality of blades can include two blades. The blade can correspond to a first of the two blades. The first of the two blades and a second of the two blades can extend away from the hub in opposite directions.

In some implementations, the autonomous cleaning robot can further include a roller on the bottom portion of the autonomous cleaning robot. The roller can be adjacent to the vacuum inlet and rotatable about an axis parallel to the floor surface.

In another aspect, an autonomous cleaning robot includes a drive system to move the autonomous cleaning robot about a floor surface, a cleaning head on a bottom portion of the autonomous cleaning robot, a side brush on the bottom portion of the autonomous cleaning robot, and a vacuum system in pneumatic communication with the opening. The cleaning head is configured to direct debris from the floor surface into the autonomous cleaning robot as the autonomous cleaning robot moves about the floor surface. The side brush is rotatable about a rotational axis forming a non-zero angle with a floor surface, and the side brush comprising an opening.

In another aspect, a side brush for an autonomous cleaning robot movable about a floor surface includes a hub rotatably mountable to the autonomous cleaning robot such that the side brush is rotatable in a direction of rotation about a rotational axis forming a non-zero angle with the floor surface and an arm including an opening at a distal end of the arm. An interior portion of the arm is configured to form part of an air pathway between the opening of the side brush and a vacuum system of the autonomous cleaning robot when the hub is mounted to the autonomous cleaning robot.

Implementations for these aspects can include one or more of the features described below and described elsewhere in this disclosure.

In some implementations, the autonomous cleaning robot can include an air pathway between the opening of the side brush and the vacuum system. The vacuum system can be configured to draw air from an environment of the autonomous cleaning robot, through the opening, and into the vacuum system. In some implementations, the side brush can include a filter in the air pathway.

In some implementations, the autonomous cleaning robot can include an air pathway between the opening of the side brush and the vacuum system. The vacuum system can be configured to draw air from an environment of the autonomous cleaning robot and through the vacuum system and eject the air out of the opening of the side brush.

In some implementations, the side brush can include a hub rotatably mounting the side brush to the bottom portion of the autonomous cleaning robot, and a plurality of arms extending outwardly from the hub. A distal end of an arm of the plurality of arms can define the opening. In some implementations, the arm can be hollow, and an interior portion of the arm can form part of an air pathway between the opening of the side brush and the vacuum system. In some implementations, the arm can be detachable from the hub. In some implementations, at least part of the arm can extend beyond an outer perimeter of the bottom portion of the autonomous cleaning robot such that the distal end of the arm and the opening are positioned outside of the outer perimeter of the bottom portion of the autonomous cleaning robot.

In some implementations, the side brush includes a plurality of openings including the opening. The vacuum system can be in pneumatic communication with each of the plurality of openings. In some implementations, the plurality of openings comprises three or more openings.

In some implementations, the side brush includes a filter in the air pathway.

In some implementations, the vacuum system can be in pneumatic communication with a vacuum inlet of the cleaning head.

In some implementations, the vacuum system can be a first vacuum system, and the autonomous cleaning robot can include a second vacuum system in pneumatic communication with a vacuum inlet of the cleaning head.

Advantages of the systems and methods described in this disclosure may include those described below and elsewhere in this disclosure. The side brush may increase the cleaning efficiency of the autonomous cleaning robot. For example, cleaning efficiency may be increased by using a side brush designed to carry debris to the debris collection apparatus of the robot more consistently and accurately, e.g., without flicking the debris away from the side brush, projecting the side brush upwardly, or otherwise causing debris to experience dynamic motion that can make collection of debris by the cleaning inlet of the robot more difficult. In some examples, the side brush may form a geometry, e.g., formed from bristles of the side brush, the bundles of the side brush, or from one or more blades of the side brush, that causes debris that contacts the side brush to maintain contact with the side brush as the side brush rotates. In embodiments in which the geometry is formed from bristles, the bristles at least partially define a pocket or space that retrieves debris and keeps the debris from being projected away from the side brush. In embodiments in which the geometry is formed from blades, the blades can include sloped and curved surfaces that tend to maintain contact with the debris along the surfaces. And in some embodiments, rather than relying on specific geometry to prevent debris from being projected away from the side brush, the side brush is integrated into a vacuum system that allows the side brush to be operated to either disperse debris on a portion of the floor surface with airflow so that the cleaning inlet can access the debris at another portion of the floor surface or to draw debris in toward the side brush to allow the side brush to direct the debris toward the cleaning inlet of the robot. Specifically, if used to disperse debris, the side brush can be used to generate an airflow to disperse the debris from regions that the robot would otherwise be unable to access, e.g., over an area that the side brush or the robot cannot physically contact.

In some embodiments, a side brush may include brush bristles of varying lengths that bring debris to the collection apparatus of the robot. Some debris may be collected more efficiently with different arrangements of bristles. In some examples, the profile of the bristles can form a geometry that captures debris that the side brush contacts, and then allows the debris to be guided to the debris collection apparatus of the robot.

Furthermore, the side brush can allow the robot to access debris on the floor surface beyond the perimeter of the robot, and can have configurations that may allow the robot to collect debris over an area of the floor surface that extends to an edge of an obstacle along the floor surface. Such a configuration could allow the robot to access debris near the obstacle more effectively.

The details of one or more embodiments of the subject matter described in this specification are set forth in the accompanying drawings and the description below. Other potential features, aspects, and advantages will become apparent from the description, the drawings, and the claims.

DETAILED DESCRIPTION

Figure 1:
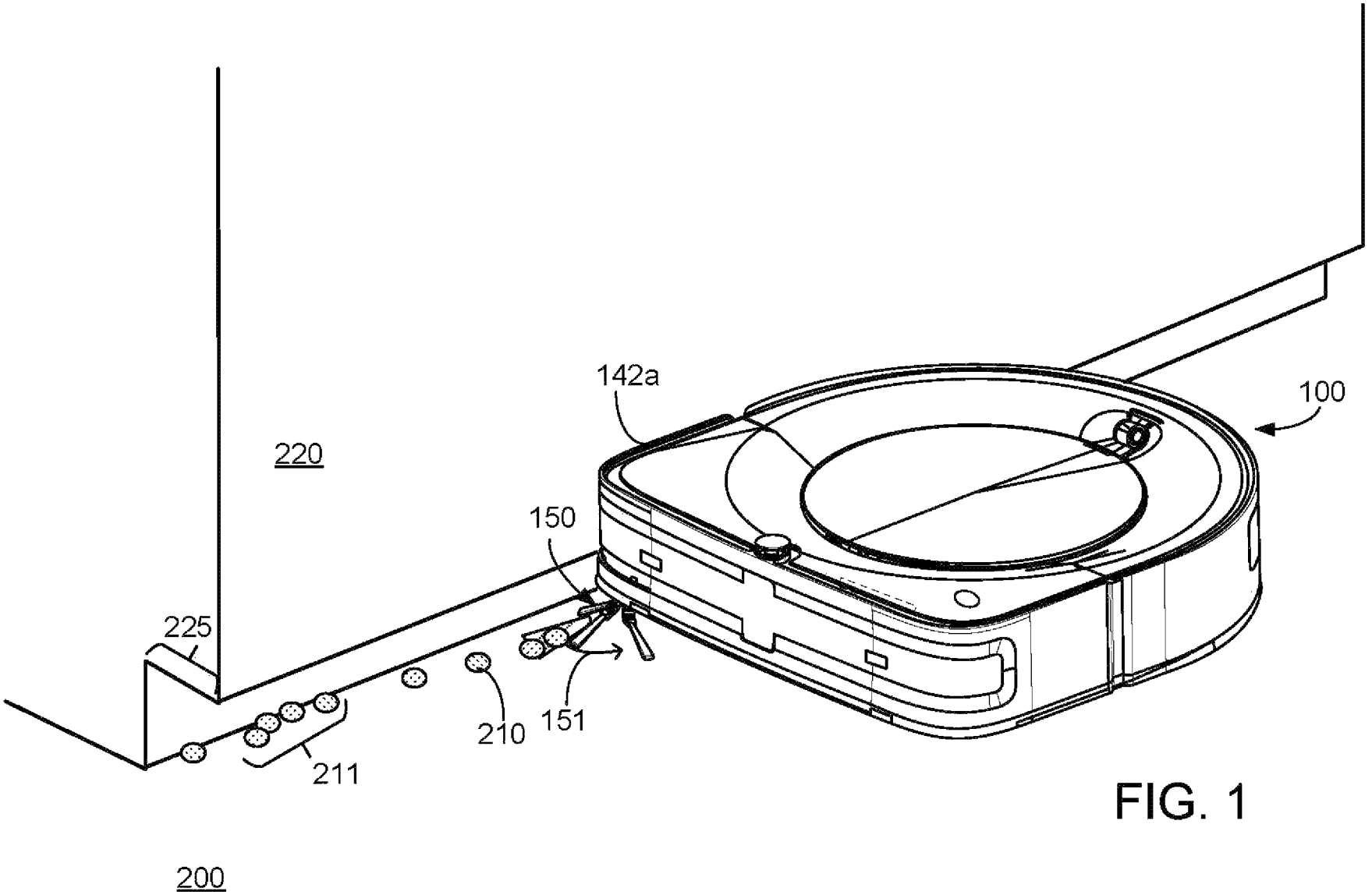
FIG. 1 is a perspective view of an autonomous cleaning robot with a brush cleaning debris along an obstacle.

Referring to FIG. 1, an autonomous cleaning robot 100 performs an autonomous cleaning operation in which the robot 100 autonomously moves about a floor surface 200 to clean the floor surface 200 by ingesting debris 210 on the floor surface 200. A side brush 150 (e.g., any embodiment of a side brush described in this disclosure, such as a side brush 400 shown in FIGS. 4A-5, a side brush 600 shown in FIGS. 6A-7, a side brush 800 shown in FIGS. 8A-9, or any other embodiments of side brushes described in this disclosure) of the robot 100 is rotatable in a rotational direction 151 (shown in FIG. 2) to direct the debris 210 toward a cleaning inlet 117 of a cleaning head 170 (shown in FIG. 2) on a bottom surface 113 (shown in FIG. 2) of the robot 100. For example, the debris 210 is positioned along an obstacle, e.g., a cabinet 220, and under an overhang portion 225 of the cabinet 220. During an obstacle following behavior, the side brush 150 guides the debris (e.g., through physical contact and/or through airflow) toward the cleaning inlet 117 as the robot 100 advances along the cabinet 220 and a lateral side 142*a* of the robot 100 tracks the cabinet 220.

In some embodiments (e.g., such as embodiments of side brushes discussed with respect to FIGS. 4A-7), the side brush 150 can physically contact debris and move the debris in a controlled manner to a location accessible by the cleaning head 170, e.g., into a cleaning region of the cleaning head 170. In further embodiments (e.g., such as embodiments of side brushes discussed with respect to FIGS. 8A to 9), the side brush 150 can use airflow to move the debris from locations inaccessible by the cleaning head 170 to locations that are accessible. In this regard, the side brushes described herein can thus improve the cleaning efficacy of the cleaning head 170. The airflow can be used to disperse debris 210 on portions of the floor surface 200 where the debris 210 would otherwise be inaccessible to the robot 100, e.g., under the overhang portion 225 of the cabinet 220.

Example Autonomous Cleaning Robots

Figure 2:
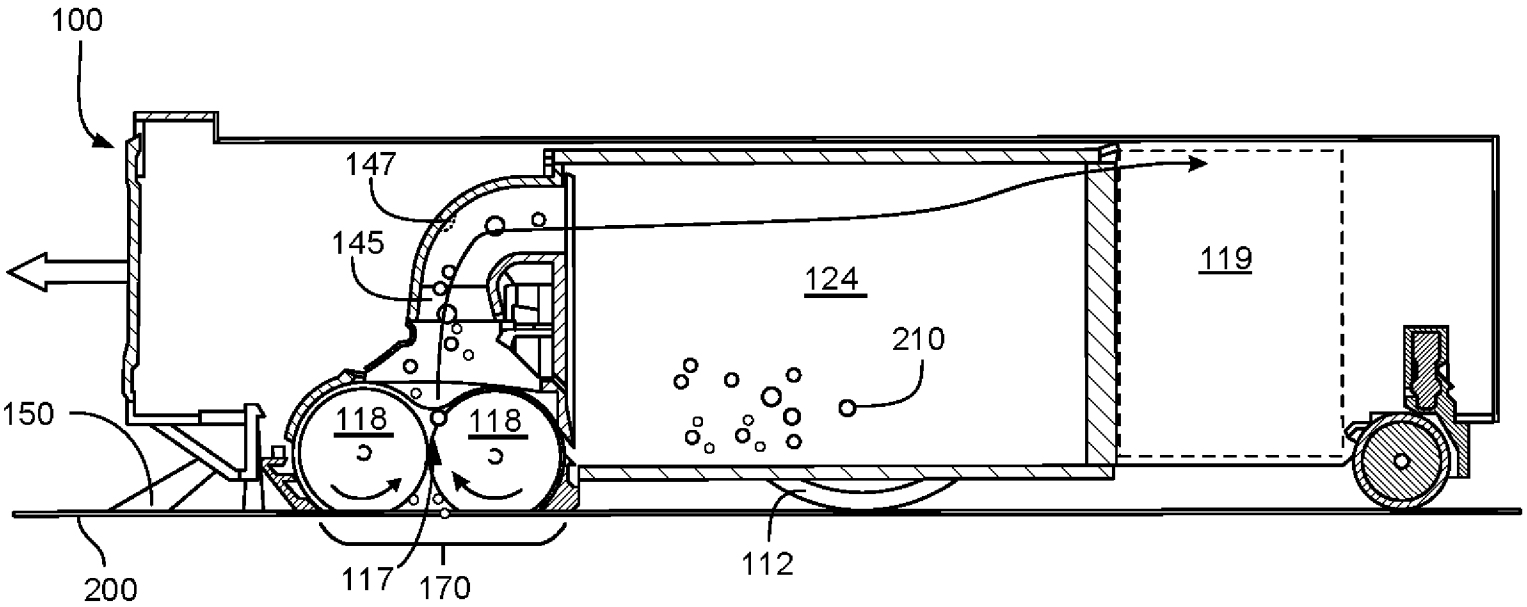
FIG. 2 is a side schematic view of the robot of FIG. 1 on a floor surface.
Figure 3A:
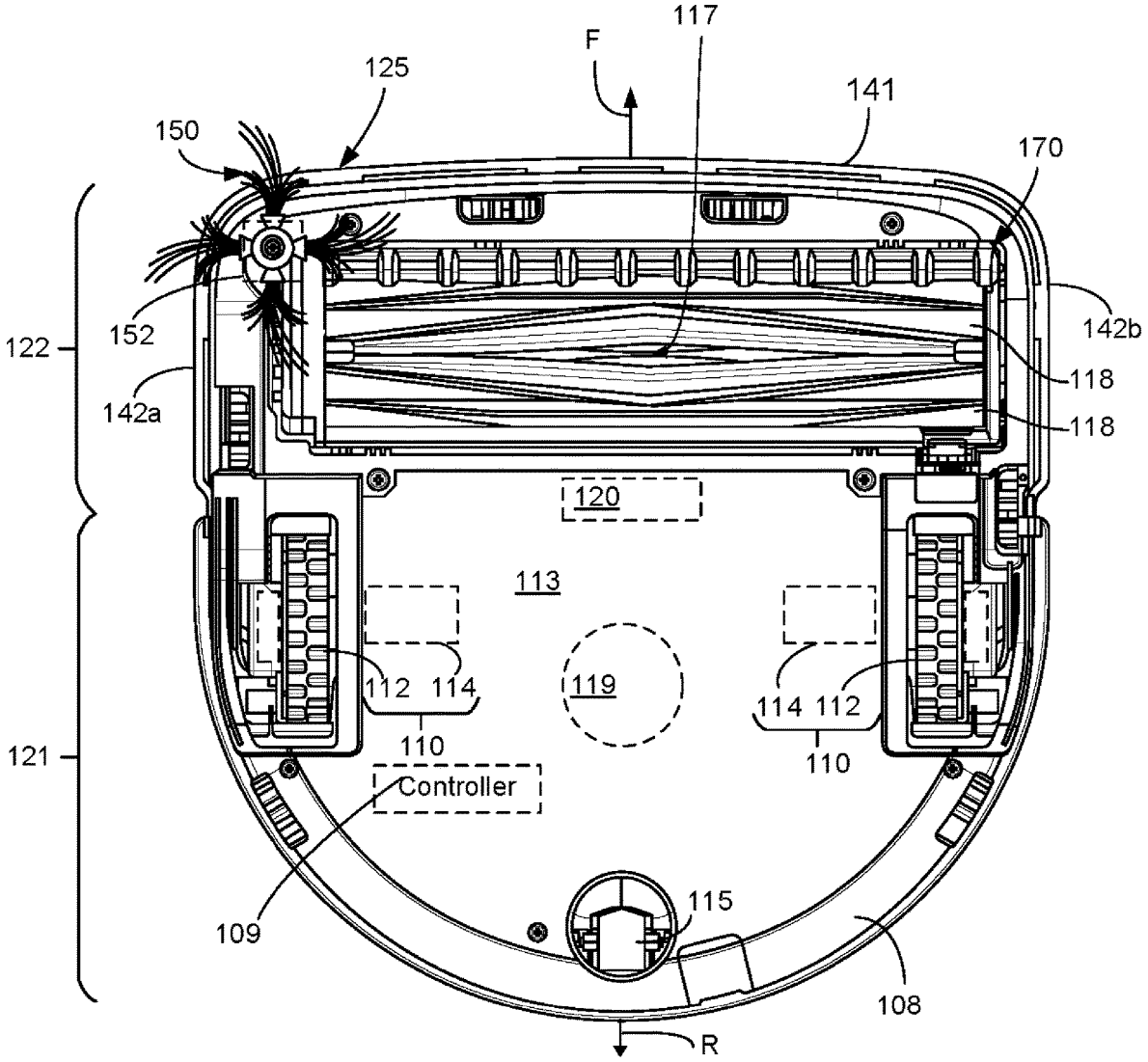
FIGS. 3A-3B are bottom and perspective schematic views, respectively, of the robot of FIG. 1.
Figure 3B:
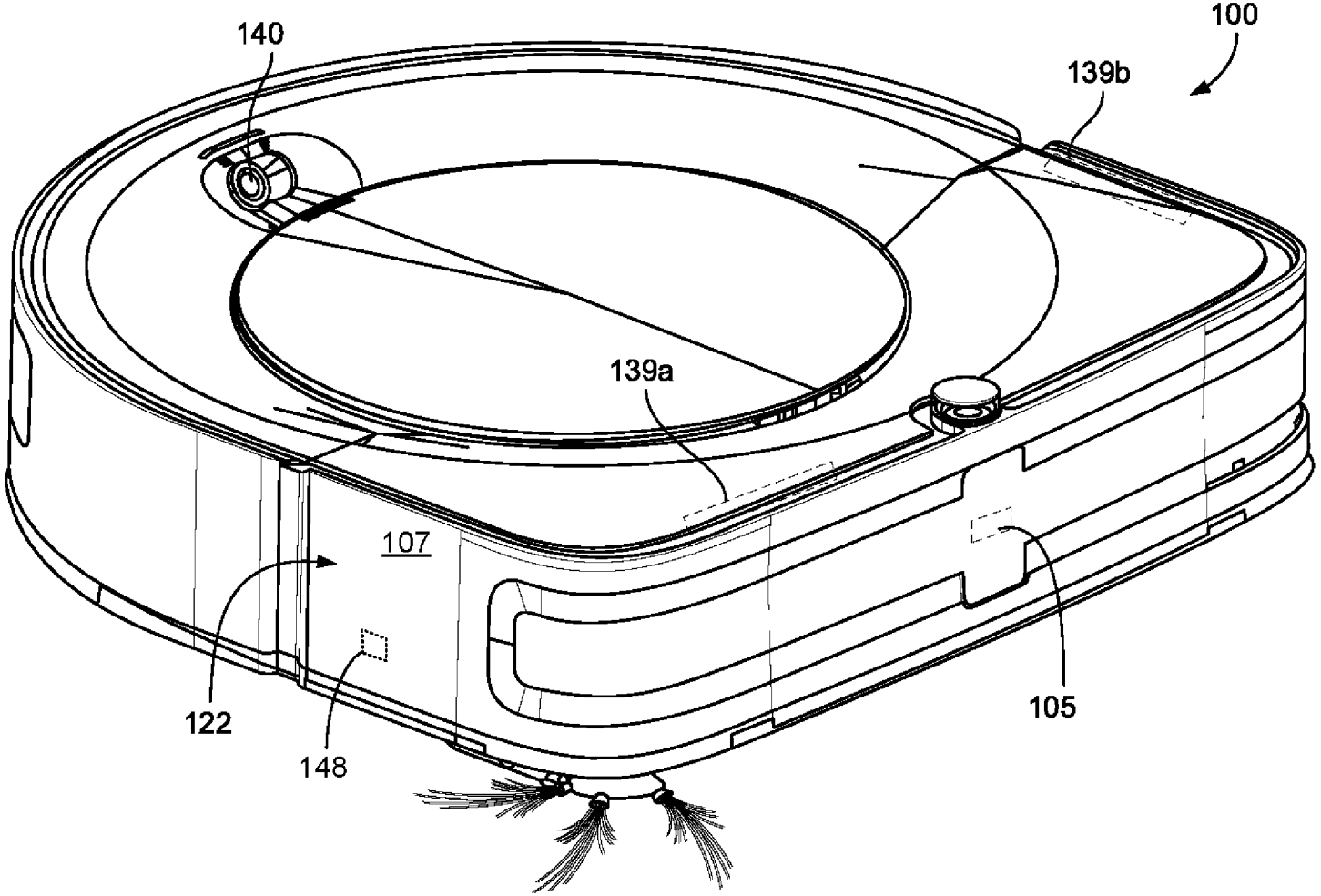

FIGS. 2 and 3A-3B depict an example of the robot 100. Referring to FIG. 2, the robot 100 collects the debris 210 from the floor surface 200 as the robot 100 traverses the floor surface 200. Referring to FIG. 3A, the robot 100 includes a robot housing infrastructure 108. The housing infrastructure 108 can define the structural periphery of the robot 100. In some examples, the housing infrastructure 108 includes a chassis, cover, bottom plate, and bumper assembly.

The robot 100 is a household robot that has a small profile so that the robot 100 can fit under furniture within a home. For example, a height (shown in FIG. 2) of the robot 100 relative to the floor surface is, for example, no more than 13 centimeters. The robot 100 is also compact. An overall length (shown in FIG. 2) of the robot 100 and an overall width (shown in FIG. 3A) are each between 30 and 60 centimeters, e.g., between 30 and 40 centimeters, 40 and 50 centimeters, or 50 and 60 centimeters. The overall width can correspond to a width of the housing infrastructure 108 of the robot 100.

Referring to FIG. 3A, the robot 100 includes a forward portion 122 that has a substantially rectangular shape. The forward surface 141 is substantially perpendicular to both of the lateral sides 142*a*, 142*b*, e.g., defines an angle between 85 degrees and 95 degrees with each of the lateral sides 142*a*, 142*b*. A rearward portion 121 of the robot 100 has a substantially semicircular shape.

The robot 100 includes a drive system 110 including one or more drive wheels. The drive system 110 further includes one or more electric motors. The housing infrastructure 108 supports electrical circuitry of the robot 100, including at least a controller 109, within the robot 100.

The drive system 110 is operable to propel the robot 100 across the floor surface 200. The robot 100 can be propelled in a forward drive direction F or a rearward drive direction R. The robot 100 can also be propelled such that the robot 100 turns in place or turns while moving in the forward drive direction F or the rearward drive direction R. In the example depicted in FIG. 3A, the robot 100 includes drive wheels 112 extending through a bottom portion 113 of the housing infrastructure 108. The drive wheels 112 are rotated by motors 114 to cause movement of the robot 100 along the floor surface 200. The robot 100 further includes a passive caster wheel 115 extending through the bottom portion 113 of the housing infrastructure 108. The caster wheel 115 is not powered. Together, the drive wheels 112 and the caster wheel 115 cooperate to support the housing infrastructure 108 above the floor surface 200. For example, the caster wheel 115 is disposed along a rearward portion 121 of the housing infrastructure 108, and the drive wheels 112 are disposed forward of the caster wheel 115.

The controller 109 is configured to operate the robot 100 during an autonomous cleaning operation constituting a sequence of one or more, possibly repeated, operation behaviors, including a coverage behavior and an obstacle following behavior. For example, the robot 100 may perform an autonomous cleaning operation in an environment having an interior portion contained by a perimeter enclosing the interior portion. The perimeter of an interior portion is defined by obstacles, e.g., furniture, wall surfaces, etc., in the environment. During the autonomous cleaning operation, the robot 100 executes a sequence of behaviors to clean the floor surface of the environment. In the coverage behavior, the robot 100 traverses the floor surface to clean the interior portion of the enclosed environment. For example, a robot 100 executing coverage behavior moves back-and-forth across the environment, turning in response to detection of the perimeter of the enclosed environment, e.g., using obstacle detection sensors of the robot 100. In the obstacle following behavior, a robot 100 moves along an obstacle and hence along the perimeter of the environment to clean the perimeter.

The cleaning head 170 can vary in embodiments. In some embodiments, the cleaning inlet 117 of the cleaning head 170 is in pneumatic communication with a vacuum system configured to draw debris into the robot 100 through the cleaning inlet 117. In some embodiments, the cleaning head 170 can include one or more rotatable members that rotate to direct debris through the cleaning inlet 117 into an interior of the robot 100. In further embodiments, the robot 100 can include both a vacuum system and one or more rotatable members.

In the example depicted in FIG. 2, the cleaning head 170 is in pneumatic communication with a vacuum system 119 configured to draw debris into the robot 100 through the cleaning inlet 117. The vacuum system 119 is operable to generate an airflow through the cleaning inlet 117. Further, in some examples, the robot 100 includes one or more rotatable members, e.g., rotatable members 118 driven by a motor 120. The rotatable members 118 extend horizontally across the forward portion 122 of the robot 100. The rotatable members 118 are positioned along a forward portion 122 of the housing infrastructure 108, and extend along 75% to 95% of a width of the forward portion 122 of the housing infrastructure 108, e.g., corresponding to an overall width of the robot 100. Referring also to FIG. 2, the cleaning inlet 117 is positioned between the rotatable members 118.

As shown in FIG. 2, the rotatable members 118 are rollers that counter rotate relative to one another. For example, the rotatable members 118 can be rotatable about parallel horizontal axes to agitate debris 210 on the floor surface 200 and direct the debris 210 toward the cleaning inlet 117, into the cleaning inlet 117, and into a suction pathway 145 (shown in FIG. 2) in the robot 100. Referring back to FIG. 3A, the rotatable members 118 can be positioned entirely within the forward portion 122 of the robot 100. The rotatable members 118 include elastomeric shells that contact debris 210 on the floor surface 200 to direct debris 210 through the cleaning inlet 117 between the rotatable members 118 and into an interior of the robot 100, e.g., into a debris bin 124 (shown in FIG. 2), as the rotatable members 118 rotate relative to the housing infrastructure 108. The rotatable members 118 further contact the floor surface 200 to agitate debris 210 on the floor surface 200. The cleaning inlet 117 is positioned between the rotatable members 118.

The vacuum system 119 is operable to generate an airflow through the cleaning inlet 117 between the rotatable members 118 and into the debris bin 124. The vacuum system 119 includes an impeller and a motor to rotate the impeller to generate the airflow. The vacuum system 119 cooperates with the rotatable members 118 to draw debris 210 from the floor surface 200 into the debris bin 124. In some cases, the airflow generated by the vacuum system 119 creates sufficient force to draw debris 210 on the floor surface 200 upward through the gap between the rotatable members 118 into the debris bin 124. In some cases, the rotatable members 118 contact the floor surface 200 to agitate the debris 210 on the floor surface 200, thereby allowing the debris 210 to be more easily ingested by the airflow generated by the vacuum system 119.

The rotatable members 118 are each disposed in the forward portion 122 of the robot 100. This enables the widths of the rotatable members 118 to extend along a greater portion of a maximum width of the robot and closer to the front of the robot 100, e.g., as compared to cases in which brushes are disposed in narrower portions of the semicircular rearward portion 121 of the robot 100 or located near the center of the robot 100 near the wheels 112. While a diameter of the semicircular rearward portion 121 of the robot 100 corresponds to an overall width of the robot 100, the forward portion 122 has a width that corresponds to the overall width of the robot 100 through nearly an entire length of the forward portion 122, e.g., through at least 90% or more of the length of the forward portion 122. In this regard, in some embodiments, the rotatable members 118 are disposed only in the forward portion 122 of the robot 100 so that the rotatable members 118 can extend across a greater portion of the overall width of the robot 100. The overall width is between, for example, 20 centimeters and 40 centimeters (e.g., between 20 centimeters and 30 centimeters, between 25 centimeters and 35 centimeters, between 30 centimeters and 40 centimeters, or about 30 centimeters). The rotatable members 118 extend across a width that is between, for example, 15 centimeters and 35 centimeters (e.g., between 15 centimeters and 25 centimeters, between 20 centimeters and 30 centimeters, between 25 centimeters and 35 centimeters, or about 25 centimeters). The width for the rotatable members 118 is 60% to 90% of the overall width of the robot 100 (e.g., between 60% and 80%, between 65% and 85%, between 70% and 90%, between 75% and 90%, between 80% and 90%, or about 75% of the overall width of the robot 100).

The electrical circuitry includes, in addition to the controller 109, a sensor system with one or more electrical sensors, for example. The sensor system, as described herein, can generate a signal indicative of a current location of the robot 100, and can generate signals indicative of locations of the robot 100 as the robot 100 travels along the floor surface 200. The controller 109 is configured to execute instructions to perform one or more operations as described herein.

The sensor system can further include a debris detection sensor 147 for detecting debris on the floor surface 200. The debris detection sensor 147 can be used to detect portions of the floor surface 200 in the space that are dirtier than other portions of the floor surface 200 in the space. In some embodiments, the debris detection sensor 147 (shown in FIG. 2) is capable of detecting an amount of debris, or a rate of debris, passing through the suction pathway 145. The debris detection sensor 147 can be used to detect debris already ingested into the robot 100 or to detect debris on the floor surface 200 without the robot 100 having to ingest the debris for the debris detection sensor 147 to detect the debris. The debris detection sensor 147 can detect information representing a type of the debris, e.g., a size, a texture, whether the debris can be ingested into the robot 100, or other information about the debris that can be used to categorize the debris.

The debris detection sensor 147 can be an optical sensor configured to detect debris as it passes through the suction pathway 145. Alternatively, the debris detection sensor 147 can be a piezoelectric sensor that detects debris as the debris impacts a wall of the suction pathway 145. In some embodiments, the debris detection sensor 147 detects debris before the debris is ingested by the robot 100 into the suction pathway 145. The debris detection sensor 147 can be, for example, an image capture device that captures images of a portion of the floor surface 200 ahead of the robot 100. The image capture device can be positioned on a forward portion of the robot 100 can be directed in such a manner to detect debris on the portion of the floor surface 200 ahead of the robot 100. The controller 109 can then use these images to detect the presence of debris on this portion of the floor surface 200.

The one or more electrical sensors are configured to detect features in an environment of the robot 100, such as objects, obstacles, features of the floor surface 200, features on walls in the environment. Detection of these features can be used as input for the controller 109 to control navigation of the robot 100 about the floor surface 200.

Referring to FIG. 3A, the sensor system can include cliff sensors disposed along the bottom portion 113 of the housing infrastructure 108. Each of the cliff sensors is an optical sensor that can detect the presence or the absence of an object below the optical sensor, such as the floor surface 200. The cliff sensors can thus detect obstacles such as drop-offs and cliffs below portions of the robot 100 where the cliff sensors are disposed and redirect the robot accordingly.

Referring to FIG. 3B, the sensor system can include one or more ranging sensor 105 that can detect positions of objects along the floor surface 200 that are near the robot 100. In some embodiments, the ranging sensor 105 is a structured light sensor. In other embodiments, the one or more ranging sensors 105 can include non-contact time of flight sensors, such as lasers, volumetric point cloud sensors, optical point sensors, optical line sensors, IR proximity sensors, LIDAR, and acoustic sensors. In embodiments in which the ranging sensor 105 is a structured light sensor, the ranging sensor 105 includes one or more light sources and one or more light detectors to detect reflections from light emitted by the light sources. The one or more light sources emit structured light that is projected along a point, an area, or along a line. In some embodiments, the light projected by the light source on the path before the robot may include focused points of light or lines of light arrayed horizontally, vertically, or both. Based on at least the location of the reflected light, the controller 109 can use triangulation, for example, to determine the position and/or height of the reflection and distinguish between the floor surface 200 and an obstacle in the path of the robot 100.

The ranging sensor 105 is mounted on the forward portion 122 of the robot 100. The ranging sensor 105 can be mounted in or behind a bumper and can be protected by a transparent window. In some embodiments, the ranging sensor 105 includes a first light emitter and a second light emitter. The first light emitter can project light along a first line in the environment, and the second light emitter can project light along a second line in the environment. For example, the first light emitter can be angled downward to project light onto the floor surface 200, and the second light emitter can be angled upward to project light above the floor surface 200. The first light emitter can be configured to project its light beam at a downward oblique angle (relative to horizontal) to intersect the floor surface 200, and the second light emitter can be configured to project its structured light at an upward oblique angle (relative to horizontal) to intersect objects above the floor surface 200. The ranging sensor 105 can include a light detector to detect reflections of the light projected by the first light emitter and the light projected by the second light emitter.

The sensor system includes a bumper system including a bumper 107 (e.g., part of the housing infrastructure 108) and one or more bump sensors that detect contact between the bumper 107 and obstacles in the environment. The bumper 107 forms part of the housing infrastructure 108. For example, the bumper 107 can form the side surfaces and the forward surface of the forward portion 122 of the robot 100. The sensor system, for example, can include the bump sensors 139*a*, 139*b*. The bump sensors 139*a*, 139*b* can include break beam sensors, capacitive sensors, or other sensors that can detect contact between the robot 100, e.g., the bumper 107, and objects in the environment. In some embodiments, the bump sensor 139*a* can be used to detect movement of the bumper 107 along the fore-aft axis FA (shown in FIG. 3A) of the robot 100, and the bump sensor 139*b* can be used to detect movement of the bumper 107 along the lateral axis LA (shown in FIG. 3A) of the robot 100. In some embodiments, the robot 100 can include proximity sensors that can detect objects before the robot 100 contacts the objects, and the bump sensors 139*a*, 139*b* can detect objects that contact the bumper 107, e.g., in response to the robot 100 contacting the objects.

The sensor system further includes an image capture device 140, e.g., a camera, on a top portion of the housing infrastructure 108. The image capture device 140 generates digital imagery of the environment of the robot 100 as the robot 100 moves about the floor surface 200. The image capture device 140 is angled in an upward direction, e.g., angled between 30 degrees and 80 degrees from the floor surface 200 about which the robot 100 navigates. The camera, when angled upward, is able to capture images of wall surfaces of the environment so that features corresponding to objects on the wall surfaces can be used for localization.

The sensor system can further include sensors for tracking a distance traveled by the robot 100. For example, the sensor system can include encoders associated with the motors 114 for the drive wheels 112, and these encoders can track a distance that the robot 100 has traveled. In some embodiments, the sensor system includes an optical sensor facing downward toward a floor surface. The optical sensor can be an optical mouse sensor. For example, the optical sensor can be positioned to direct light through the bottom surface 113 of the robot 100 toward the floor surface 200. The optical sensor can detect reflections of the light and can detect a distance traveled by the robot 100 based on at least changes in floor features as the robot 100 travels along the floor surface 200.

An edge following sensor 148 of the robot 100 can be used to detect an obstacle on a lateral side of the robot 100. The edge following sensor 148, in this regard, is also an obstacle detection sensor. The edge following sensor 148 can be, for example, an optical sensor, an ultrasonic sensor, or another ranging sensor that is used to detect the obstacle. The edge following sensor 148 can generate signals indicative of a distance of the detected obstacle from the robot 100. These signals can be used by the controller 109 to navigate the robot 100 in an edge following mode in which the robot 100 is controlled to follow an edge of the obstacle on the floor surface 200 while maintaining a distance between the robot 100 and the obstacle, e.g., between a lateral side of the robot 100 on which the edge following sensor 148 is positioned and the edge of the obstacle.

In further embodiments, the robot 100 can include other obstacle detection sensors positioned around a periphery of the robot 100. For example, in addition to the ranging sensor 105, the robot 100 can include one or more proximity sensors on a front portion of the robot 100. The proximity sensors can also be used to detect obstacles forward of the robot 100.

As described herein, the robot 100 further includes the side brush 150 (also referred to as a corner brush when placed in a corner), which is rotatable to direct debris toward the cleaning head 170 of the robot 100 so that the cleaning head 170 can collect the debris in the debris bin 124. The example side brush 150 depicted in FIGS. 3A-3B corresponds to the example of the side brush depicted in FIGS. 4A-5, though the side brush 150 can vary in embodiments as described in this disclosure. The side brush 150 extends outwardly away from the robot 100 and away from the bottom surface 113 of the robot 100. The side brush 150 is mounted to a motor 152 of the robot 100, the motor 152 being operatively connected to the controller 109.

The controller 109 is configured to operate the motor 152 to rotate the side brush 150. The side brush 150 extends across a width between 2 centimeters and 12 centimeters (e.g., between 2 centimeters and 12 centimeters, between 2 centimeters and 4 centimeters, between 4 centimeters and 12 centimeters, between 6 centimeters and 10 centimeters, between 7 centimeters and 9 centimeters, about 3 centimeters, or about 8 centimeters). The width of the side brush 150 is between 15% and 35% of the width of the robot 100 (e.g., between 15% and 25%, between 20% and 30%, between 25% and 35%, or about 25% of the width of the robot 100). The width is between 5% and 40% of the width of the cleaning head 170 (e.g., between 5% and 15%, between 10% and 20%, between 20% and 30%, between 25% and 35%, between 30% and 40%, about 10%, or about 30% of the width of the cleaning head 170). A portion of the width of the cleaning head 170 that overlaps the width of the side brush 150 is between, for example, 0.5 centimeters and 5 centimeters (e.g., between 0.5 and 1.5 centimeters, between 1.5 centimeters and 4 centimeters, between 2 centimeters and 4.5 centimeters, between 2.5 centimeters and 5 centimeters, about 1 centimeter, or about 2.5 centimeters).

The side brush 150 is located proximate one of the lateral sides 142*a*, 142*b* of the robot 100. In the example depicted in FIG. 3A, the side brush 150 is located proximate the lateral side 142*a* such that at least a portion of the side brush 150 extends beyond the lateral side 142*a* during rotation of the side brush 150. A center of the side brush 150 is mounted between 1 centimeter and 5 centimeters from the lateral side 142*a* (e.g., between 1 and 3 centimeters, between 2 and 4 centimeters, between 3 and 5 centimeters, or about 3 centimeters from the lateral side 142*a*). The side brush 150 extends beyond the lateral side 142*a* by between 0.25 centimeters and 2 centimeters (e.g., at least 0.25 centimeters, at least 0.5 centimeters, at least 0.75 centimeters, between 0.25 centimeters and 1.25 centimeters, between 0.5 centimeters and 1.5 centimeters, between 0.75 centimeters and 1.75 centimeters, between 1 centimeter and 2 centimeters, or about 1 centimeter).

The side brush 150 is also located proximate the forward surface 141 such that at least a portion the side brush 150 extends beyond the forward surface 141 of the robot 100 during rotation of the side brush 150. In some examples, the center of the side brush 150 is mounted between 1 and 5 centimeters from the forward surface 141 (e.g., between 1 and 3 centimeters, between 2 and 4 centimeters, between 3 and 5 centimeters, or about 3 from the forward surface 141). The side brush 150 extends beyond the forward surface 141 by between 0.25 centimeters and 2 centimeters (e.g., at least 0.25 centimeters, at least 0.5 centimeters, at least 0.75 centimeters, between 0.25 centimeters and 1.25 centimeters, between 0.5 centimeters and 1.5 centimeters, between 0.75 centimeters and 1.75 centimeters, between 1 centimeter and 2 centimeters, about 1 centimeter, or about 0.75 centimeters).

In the case in which the side brush 150 is proximate both the lateral side 142*a* and the forward surface 141, the side brush 150 is thus located proximate a corner portion 125 of the robot 100, the corner portion 125 being defined by one of the lateral sides 142*a*, 142*b* and the forward surface 141. In some cases, the corner portion 125 includes a rounded portion connected by a lateral side 142*a* or 142*b* and the forward surface 141, with a segment of the corner portion 125 defined by a lateral side 142*a* or 142*b* and a segment of the forward surface 141 forming substantially a right angle.

The corner portion 125 can fit into corresponding corner geometries found in a home, e.g., defined by obstacles. For example, the corner portion 125 can fit into corresponding right-angled geometries defined by obstacles in the home. By being positioned such that at least a portion of the side brush 150 extends beyond both the forward surface 141 and a lateral side 142*a* or 142*b*, the side brush 150 can easily access and manipulate debris on a floor surface outside of a region directly beneath the robot 100.

Example Side Brushes

Figure 4A:
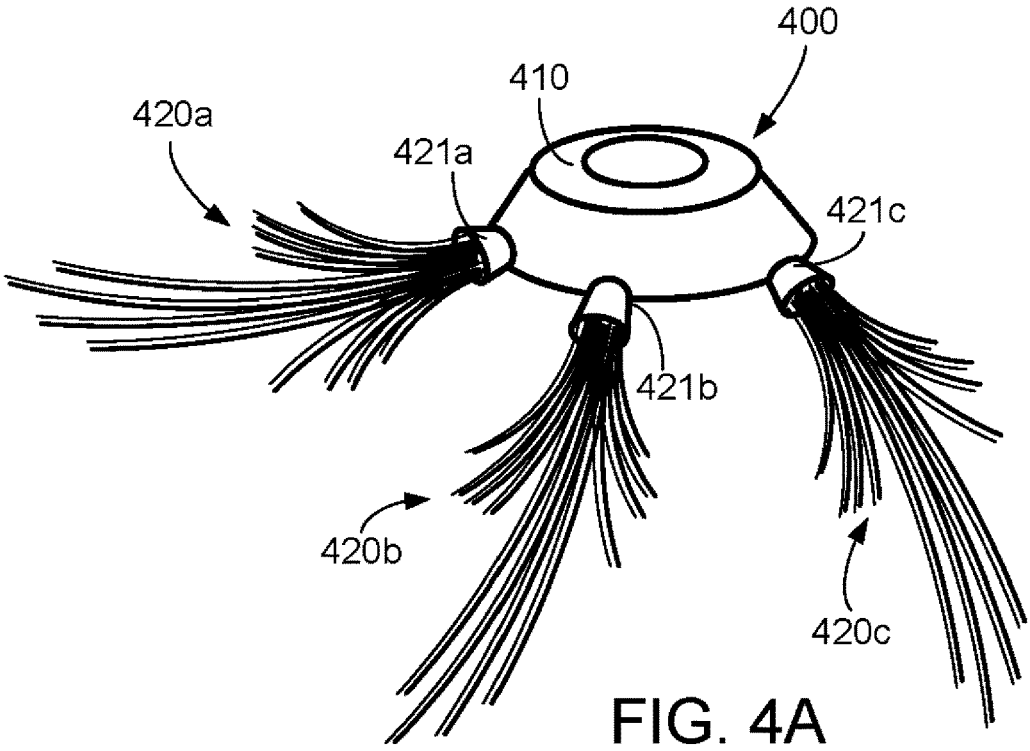
FIGS. 4A-4C are perspective, side, and top views, respectively, of a side brush according to a first set of embodiments.
Figure 4B:
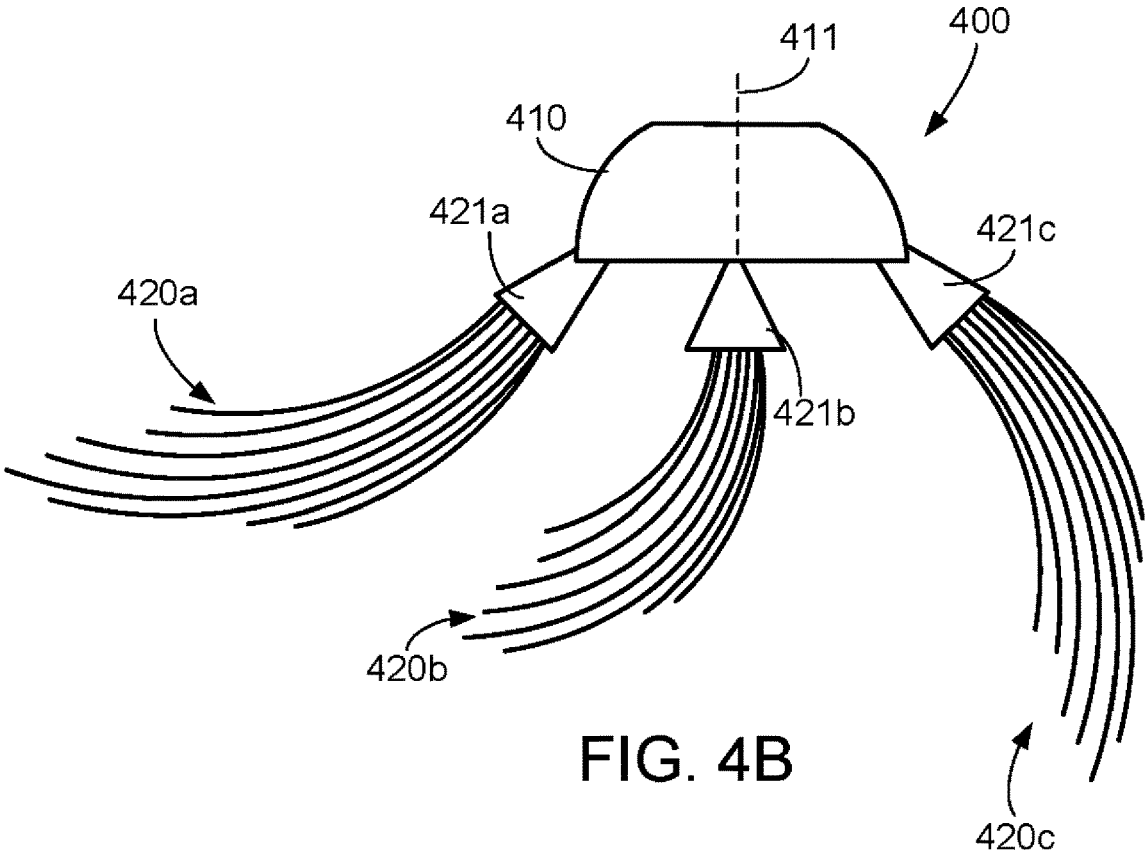
Figure 4C:
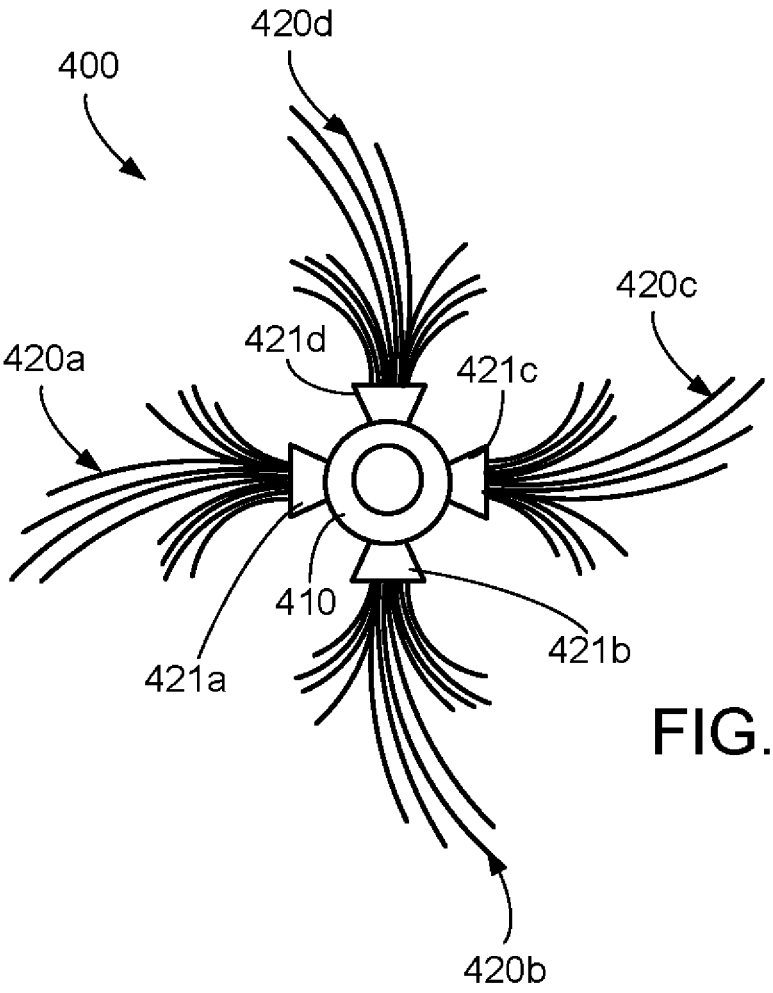
Figure 4D:
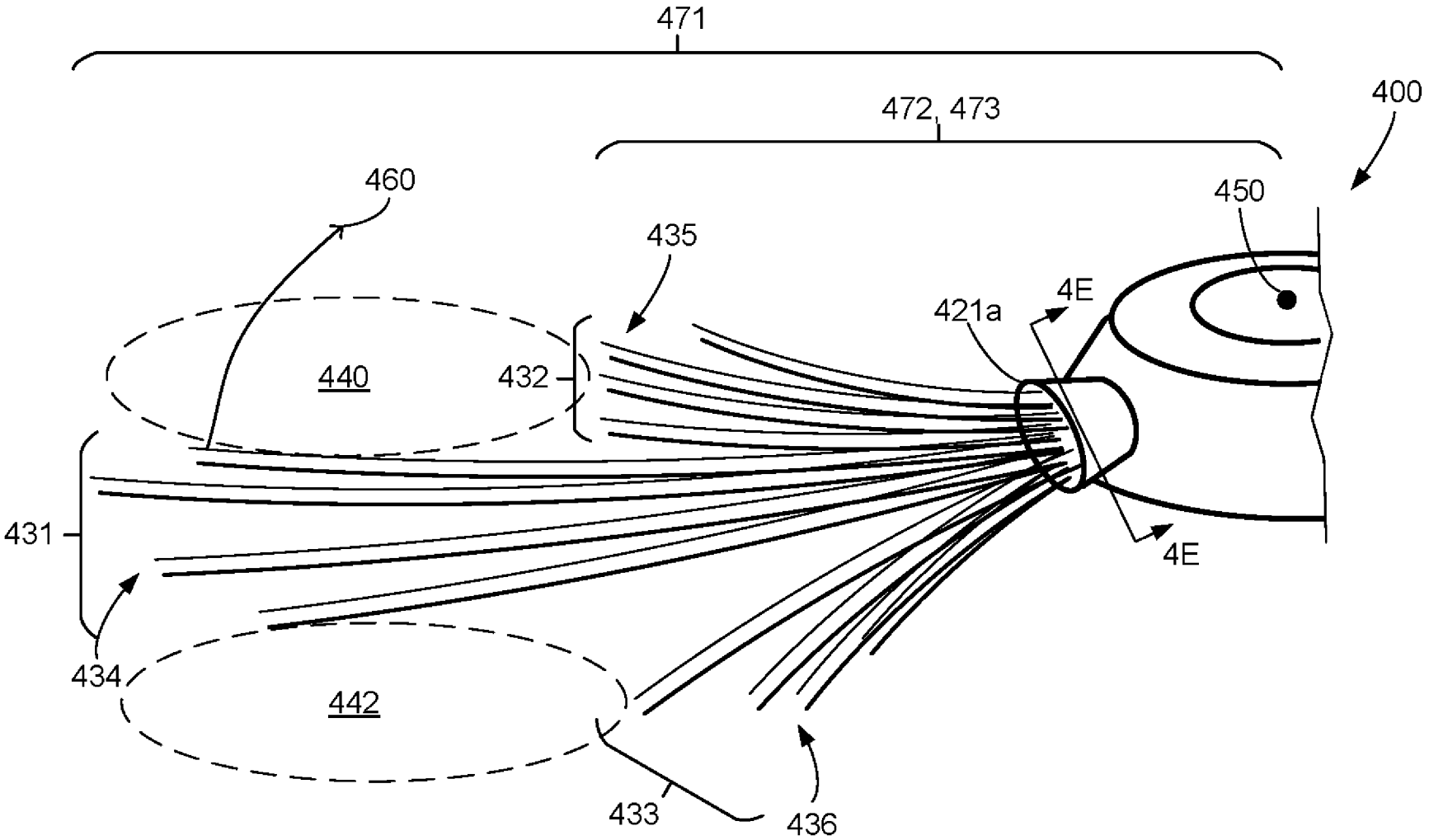
FIG. 4D is a perspective view of a bristle bundle of the side brush of FIGS. 4A-4C.
Figure 4E:
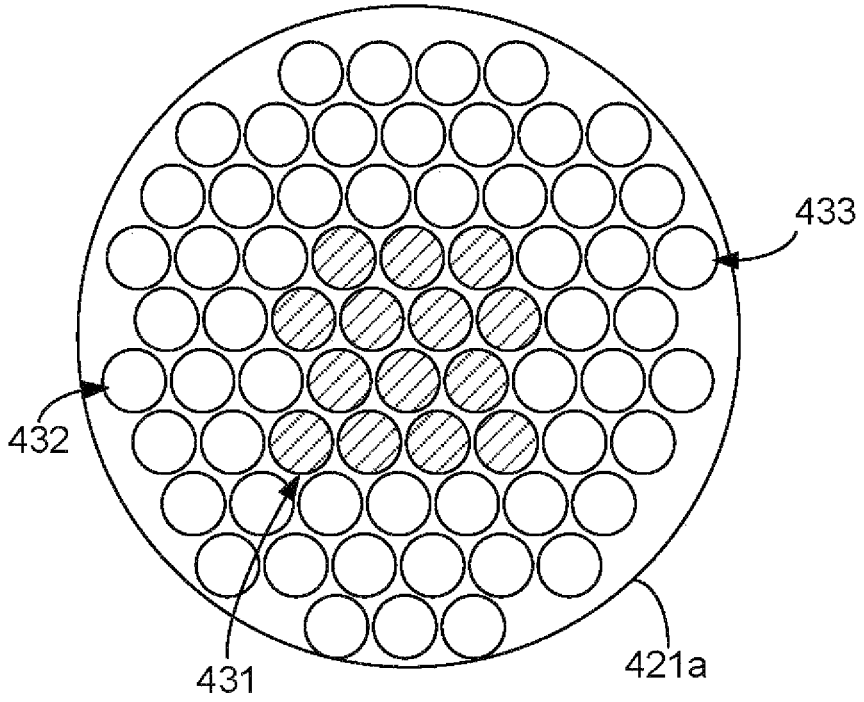
FIGS. 4E-4F are exemplary cross-sectional views along the section 4E-4E shown in FIG. 4D.
Figure 4F:
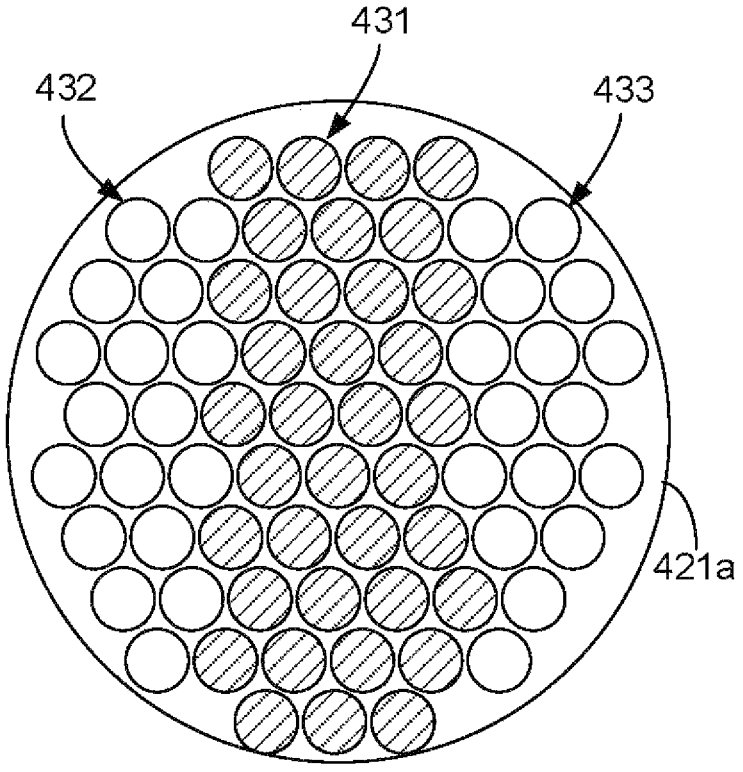
Figure 5:
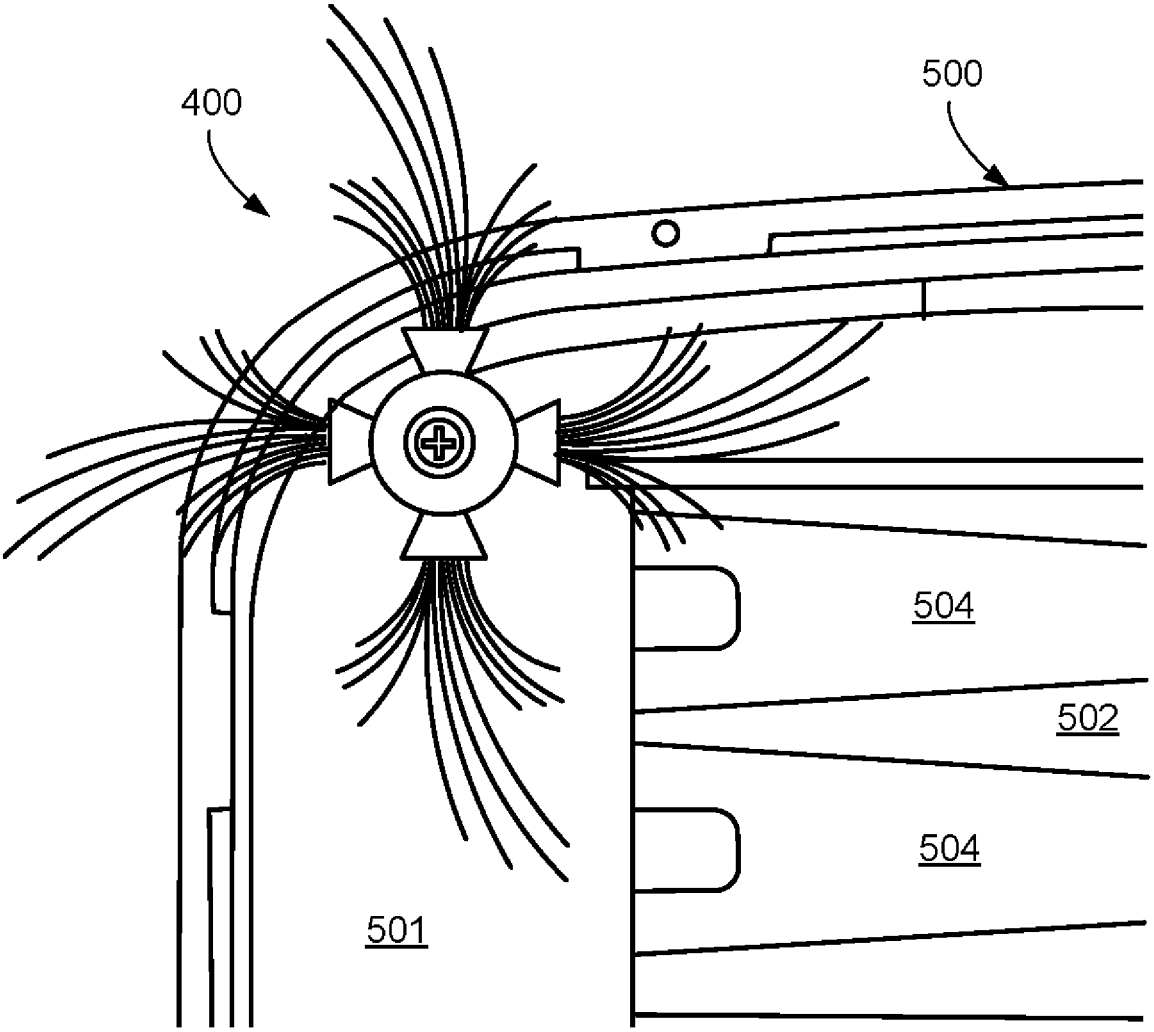
FIG. 5 is a partial bottom view of an autonomous cleaning robot with the side brush of FIGS. 4A-4C.

FIGS. 4A-5 illustrate an example of a side brush, e.g., the side brush 400. Referring to FIGS. 4A-5, the side brush 400 includes a hub 410 and multiple bundles 420*a*, 420*b*, 420*c*, 420*d* (collectively referred to as bundles 420, and shown in FIG. 4C) of bristles 430 having various lengths extending radially outwardly from the hub 410. The bundles 420 are attached to the side brush 400 by arms 421*a*, 421*b*, 421*c*, 421*d* (collectively referred to as arms 421) that are evenly spaced about the hub 410. The side brush 400 can sweep debris on the floor surface by physically contacting the debris as the side brush 400 is rotated. As the side brush 400 rotates, the side brush 400 can sweep debris toward a cleaning inlet 502 of the robot 500.

Referring to FIGS. 4A-4C, the side brush 400 includes a hub 410 that is rotatably mountable to the robot 500, e.g., to a bottom portion 501 of the robot 500 (shown in FIG. 5), such that the side brush 400 is rotatable about a rotational axis 411. The hub 410 is mountable to the robot 500 such that the rotational axis 411 of the side brush 400 forms an angle between 0 and 5 degrees with a vertical axis. The hub 410, for example, is mounted to a motor (e.g., the motor 152) of the robot 500. The hub 410, when driven by the motor, rotates, thereby causing the arms 421 and the bundles 420 to rotate as well.

The bristle bundles 420 are attached to the hub 410 via the arms 421. This disclosure describes features of the bundle 420*a* and the arm 421*a*. The number of bristle bundles and arms can vary in embodiments. For example, in some embodiments, the side brush 400 can include one, two, three, five, six, or more, bristle bundles and arms. The bundles 420*b*, 420*c*, 420*d* and the arms 421*b*, 421*c*, 421*d* can have features similar to those described with respect to the bundle 420*a* and the arm 421*a* below.

Referring to FIG. 4D, the bundle 420*a* includes bristles of varying lengths. The bundle 430*a* includes a first set of bristles 431, a second set of bristles 432, and a third set of bristles 433. The first set of bristles 431 have distal tips 434 at approximately a first distance 471 from a center 450 of the side brush 400, a second set of bristles 432 have distal tips 435 at approximately a second distance 472 from the center 450 of the side brush 400, and a third set of bristles 433 have a distal tip 436 at approximately a third distance 473 from the center 450 of the side brush 400. As shown in FIG. 4C, the first distance 471 is greater than the second distance 472 and the third distance 473. The bristles within each set of bristles 431, 432, 433 may vary in length. In this regard, the first, second, and third distance 473 can correspond to average distances between the distal tips 434, 435, 436 and the center 450, to a maximum distance between the distal tips 434, 435, 436 and the center 450, or to a minimum distance between the distal tips 434, 435, 436 and the center 450.

The first, second, and third distances 471, 472, 473 for the sets of bristles 431, 432, and 433 can vary in embodiments. In some embodiments, the second and third distances 473 can be equal to one another. In some embodiments, the first distance 471 is 25% to 75% (e.g., 25% to 50%, 40% to 60%, 50% to 75%, etc.) greater than the second distance 472. The first distance 471 can be between 3 and 10 centimeters, and the second and third distances can be between 1 and 5 centimeters.

The bristle bundle 420*a* is attached to the side brush 400 via the arm 421*a* extending from the hub 410. An arm 421*a* is attached to a bristle bundle 420*a* to the hub 410 such that bristle bundle 420 extends from a distal end of the arm 421*a* to the distal tips of the bristles 430 of the bundle 420. A proximal end of the arm 421*a* is attached to the hub 410.

The arm 421*a* may extend radially outward from the axis of rotation of the side brush 400. In some embodiments, the arm 421*a* may further extend downwardly toward the floor surface, e.g., forming an angle between 5 and 45 degrees with a horizontal axis. The arm 421*a* may also extend at an angle relative to a radial axis, e.g., forming an angle between 5 and 15 degrees.

The arm 421*a* tightly surrounds the bristle bundle 420*a* at proximal ends of the bristles of the bristle bundle 420*a*. The first set of bristles 431 of the bristle bundle 420*a* corresponds to a central set of bristles of the bristle bundle 420*a*. The second and the third sets of bristles 432, 433 are positioned radially outwardly from a center of the arm 421 relative to the first set of bristles 431, which are positioned at the center of the arm 421.

FIGS. 4D-4E illustrate different example of configurations for the first, second, and third sets of bristles 431, 432, 433, specifically showing example transverse cross-sections of the bristle bundle 420*a* through the arm 421*a*. FIG. 4D shows an example in which the first set of bristles 431 (schematically represented as shaded in FIG. 4D) is surrounded by the second and the third sets of bristles 432, 433. In such examples, the second and the third sets of bristles 432, 433 form a substantially uniform set of bristles that surround the first, central set of bristles 431. Specifically, the sets of bristles 432, 433 are positioned 360 degrees around the set of bristles 431 in the transverse cross-section. FIG. 4E shows another example in which the first set of bristles 431 (schematically represented as shaded in FIG. 4D) is positioned between the second and third sets of bristles 432, 433. The second and third sets of bristles 432, 433 are separated from one another by the first set of bristles 431. The second and the third sets of bristles 432, 433 are positioned on lateral sides of the first set of bristles 431 and in particular, are positioned such that the second and the third sets of bristles 432, 433 are facing laterally, e.g., toward or opposite the direction of rotation of the side brush 400.

The configurations of the sets of bristles 431, 432, 433 define one or more spaces for retrieving debris as the side brush 400 rotates. For example, in the example shown in FIG. 4C, the first set of bristles 431 and the second set of bristles 432 define a space 440, and the first set of bristles 431 and the third set of bristles 433 define a space 442. The space 440 extends from the distal tip 435 of the second set of bristles 432 to the distal tips 434 of the first set of bristles 431, and the spaces 442 extends from the distal tip 436 of the third set of bristles 433 to the distal tips 434 of the first set of bristles 431. The spaces 440 and 442 can be symmetrically positioned about a radial axis along which the arm 421*a* extends. As described in this disclosure, the spaces 440 and 442 defined by the bristles 430 having varying lengths can allow the bristles 430 to capture debris in a controlled manner, e.g., by allowing the set of longer bristles 431 to contact the debris and then maintain the debris within the spaces 440, 442. For example, if the side brush 400 is rotated in a rotational direction 460, debris that the bristles 430 contact can be maintained within the space 440.

The number of bristles 430 in a bristle bundle 420 of a side brush 400 may range from 20 to 200. The first, second, and third sets of bristles 431, 432, 433 contain first, second, and third quantities of bristles, respectively. The first set of bristles 431 may be more numerous than the second set of bristles 432, the third set of bristles 433, or the sum of the second and third sets of bristles 432, 433. For example, the second quantity of bristles in the second set of bristles 432 is less than the first quantity of bristles in the first set of bristles 431. For example, the first quantity is 25% to 200% more than the second quantity and 25% to 200% more than the third quantity. The second and third sets of bristles 432, 433 may have the same number of bristles. The first quantity can be equal to the sum of the second and third quantities.

The first, second, and third sets of bristles 431, 432, 433 of the side brush 400 may be formed of materials having different properties. The first set of bristles 431 can be formed of a first material (e.g., a first polymer), the second set of bristles 432 can be formed of a second material (e.g., a second polymer). The first material can be less stiff than the second material. The lower stiffness of the first set of bristles 431 can further facilitate retrieval of debris and reduce the force imparted by the first set of bristles 431 on debris, thereby reducing the likelihood of the debris being propelled by the first set of bristles 431.

Referring to FIG. 5, the side brush 400 is mounted to the robot 500, e.g., to a corner portion of the robot 500. The side brush 400, during a cleaning operation of the robot 500, is configured to rotate to direct debris toward a cleaning inlet 502 (e.g., similar to the cleaning inlet 117) of the robot 500 and rotatable members 504 (e.g., similar to the rotatable members 118) of the robot 500. The side brush 400 is rotatable to retrieve debris on the floor surface and move the debris to from a first position outside of the perimeter of the robot 500 to a second position within the perimeter of the robot 500. In particular, the side brush 400 can retrieve the debris and move the debris so that the cleaning inlet 502 and the rotatable members 504 can retrieve the debris.

Figure 6A:
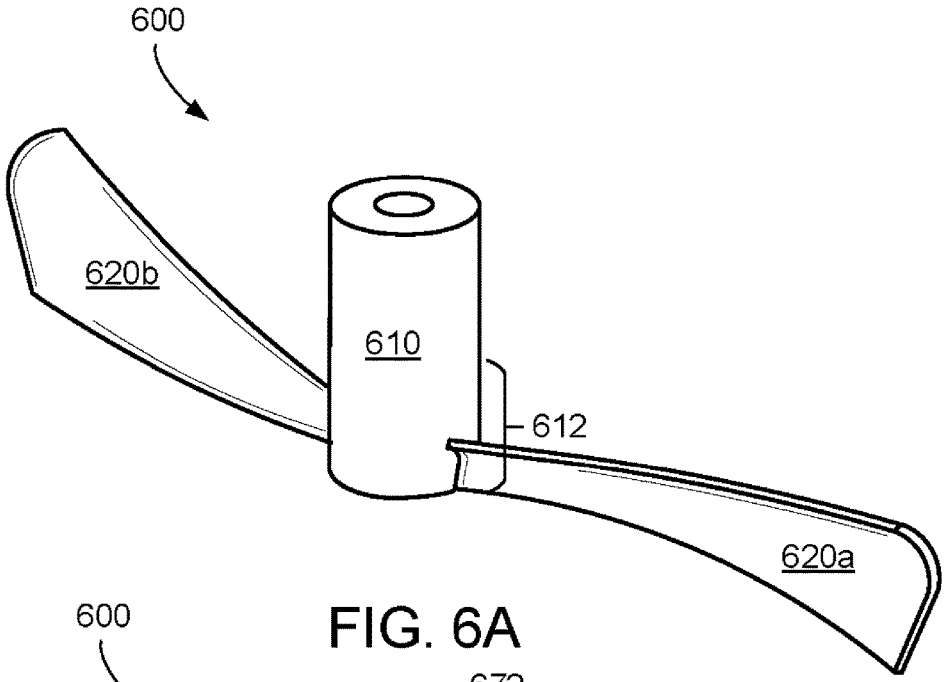
FIGS. 6A-6B are perspective and front views, respectively, of a side brush according to a second set of embodiments.
Figure 6B:
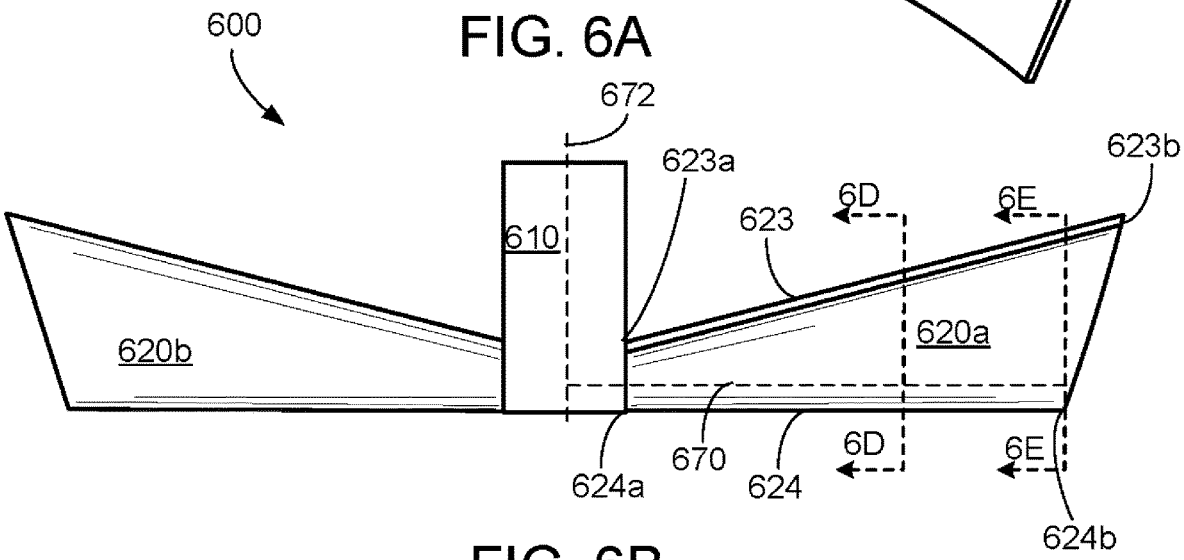
Figure 6C:
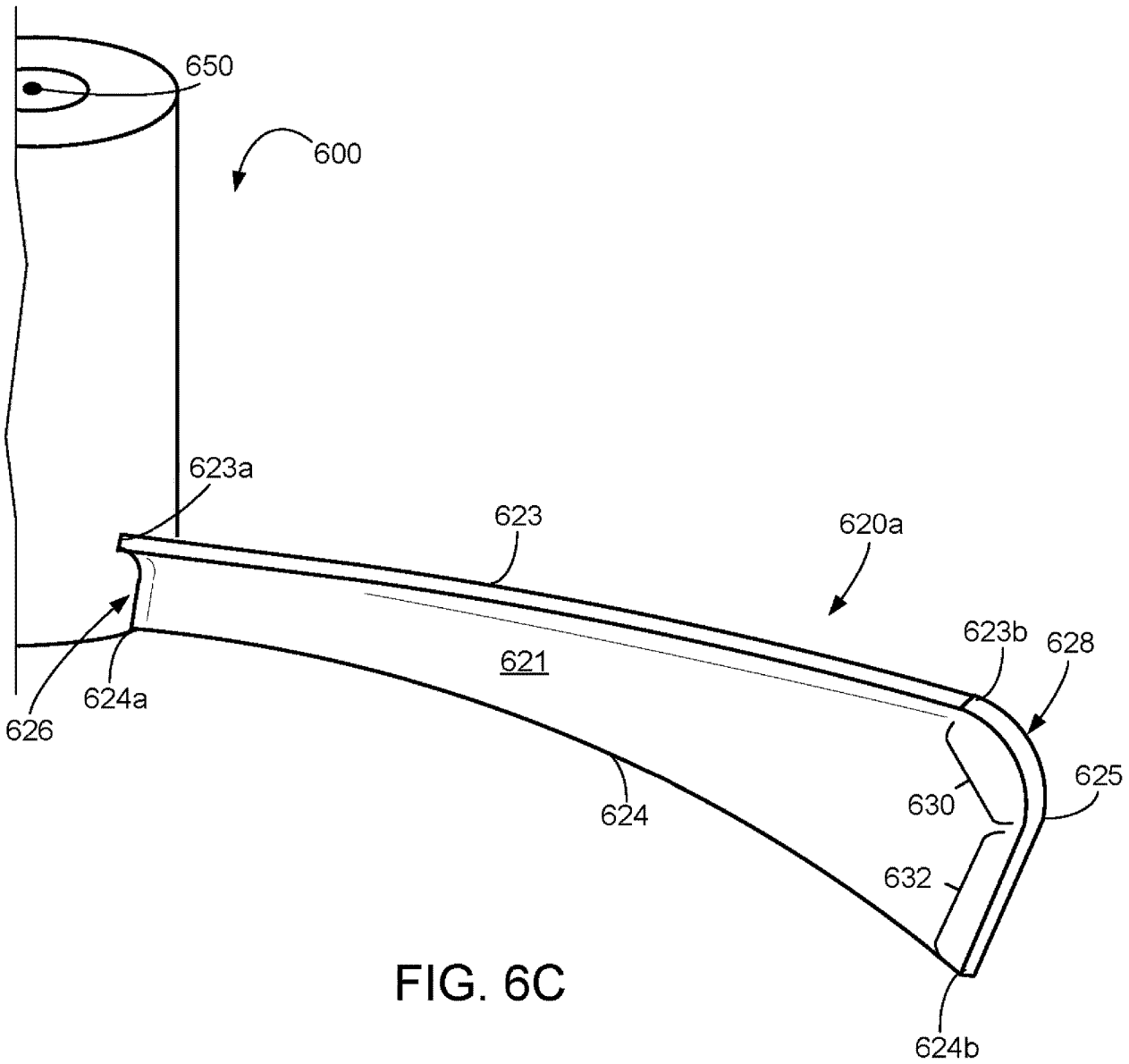
FIG. 6C is a perspective view of a blade of the side brush of FIGS. 6A-6B.
Figure 6D:
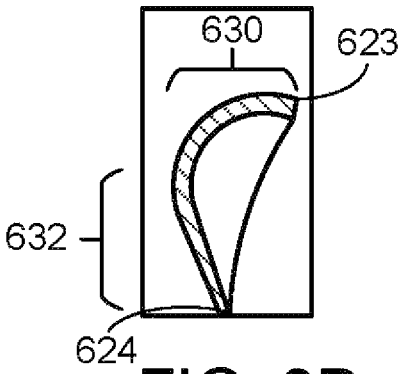
FIG. 6D is a side cross-sectional view of the blade of FIG. 6C along the section 6D-6D shown in FIG. 6B.
Figure 6E:
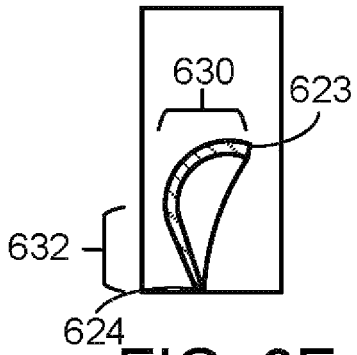
FIG. 6E is a side cross-sectional view of the blade of FIG. 6C along the section 6E-6E shown in FIG. 6B.
Figure 7:
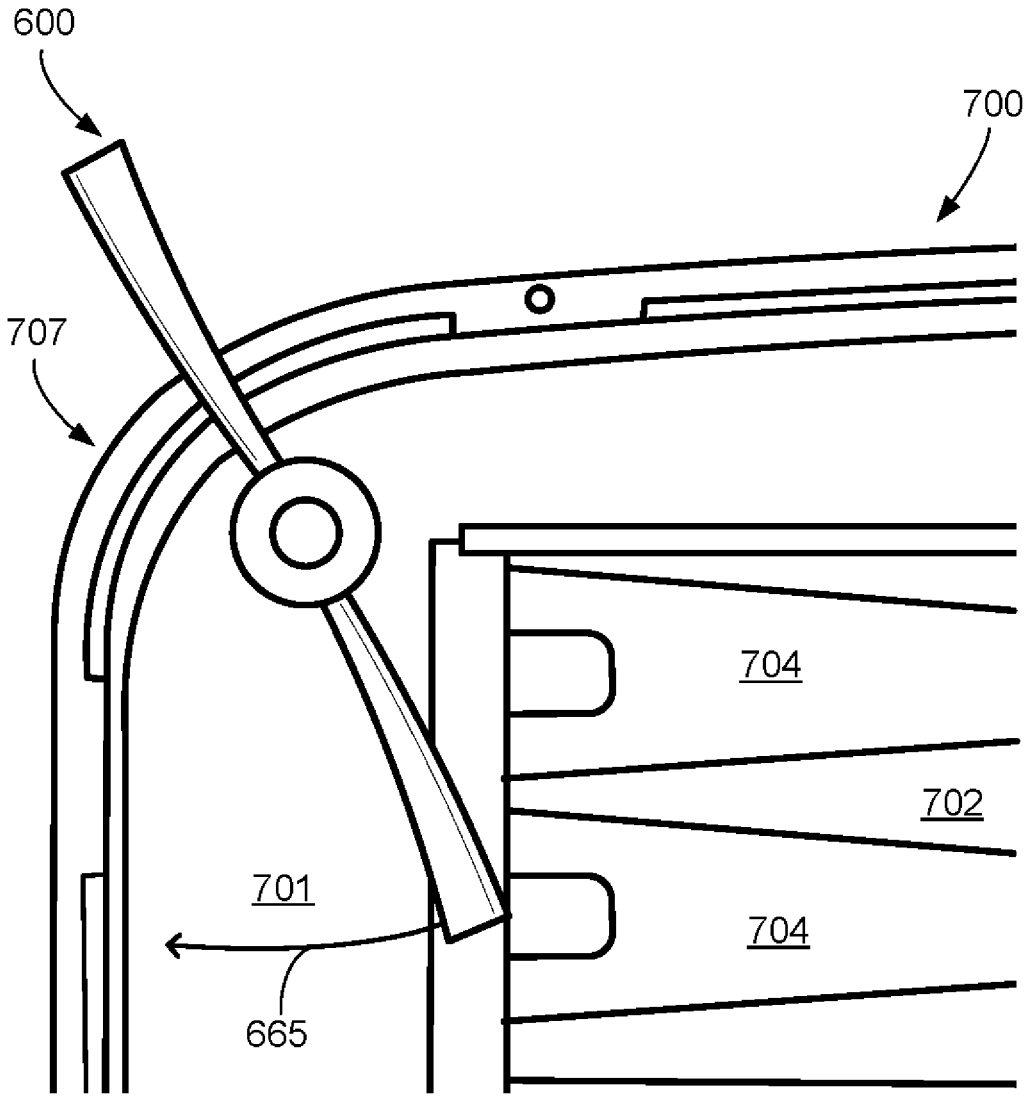
FIG. 7 is a partial bottom view of an autonomous cleaning robot with the side brush of FIGS. 6A-6D.

FIGS. 6A-7 illustrate a further example of a side brush, e.g., the side brush 600. Referring to FIGS. 6A-7, the side brush 600 includes a hub 610 and blades 620*a*, 620*b* (collectively referred to as blades 620) extending radially outwardly from the hub 610. The side brush 600, as described in this disclosure, can scoop and carry debris on the floor surface by physically contacting the debris as the side brush 600 is rotated. The side brush 600, when rotated, retrieves on debris on the floor surface and moves the debris toward a cleaning inlet of an autonomous cleaning robot 700 (shown in FIG. 7, similar to the robot 100 with the exception of certain features associated with the side brush 600 as described in this disclosure).

Referring to FIG. 6A, the hub 610 is rotatably mountable to the robot 700, e.g., to a bottom portion 701 of the robot 700 (shown in FIG. 7). Referring also to FIG. 7, the hub 610 can be coupled to a motor (e.g., similar to the motor 152) and the motor can be operated to rotate the hub 610 and thus the side brush 600 relative to the bottom portion 701 of the robot 700 as the robot 700 cleans a floor surface.

In the example depicted in FIGS. 6A-6B, the blades 620 is attached to the hub 610 at locations along the hub 610 that are spaced apart from one another such that the blades 620 of the side brush 600 each extend radially outwardly from the hub 610. For example, the blades 620*a*, 620*b* can be attached to the hub 610 at locations such that the two blades 620*a*, 620*b* extend away from the hub 610 in opposite directions (as illustrated in FIGS. 6A-6B). The blades 620 can be attached to a bottom portion 612 of the hub 610. In some embodiments, the blades 620 are detachable from the hub 610 such that the blades 620 can be easily replaced by a user.

The blade 620*b* can have features similar to those described with respect to the blade 620*a* below. Referring to FIG. 6C, the blade 620*a* extends from a proximal end 626 attached to the hub 610 to a distal end 628. The distal end 628 is a free end of the blade 620*a*. The length from the proximal end 626 to the distal end 628 of the blade 620*a* can be, for example, between 3 centimeters and 10 centimeters (e.g., between 3 and 5 centimeters, 3 and 7 centimeters, etc.). The blade 620*a* includes a concave surface 621, an upper edge 623, a lower edge 624, and a distal edge 625.

The concave surface extends from the proximal end 626 of the blade 620*a* to the distal end 628 of the blade 620*a* along a radial axis 670 extending through a rotational axis 672 of the side brush 600, e.g., the rotational axis 672 through a center 650 of the side brush 600). The concave surface 621 of the blade 620 is formed between the proximal end 626 of the blade 620*a* and the distal end 628 of the blade 620*a* such that the concave surface 621 faces a direction of rotation 665 (shown in FIG. 7), and the concave surface 621 of the blade 620 is positioned between the lower edge 624 and the upper edge 623. The concave surface 621 of the blade 620*a* can extend from the proximal end 626 of the blade 620*a* to the distal end 628 of the blade 620 along the radial axis 670.

Referring to FIG. 6B, the upper edge 623 extends away from the lower edge 624 as the upper edge 623 extends radially outwardly from the hub 610 of the side brush 600. The upper edge 623 is attached to the hub 610 at a location above a location at which the lower edge 624 is attached to the hub 610.

The lower edge 624 extends from a first proximal end 624*a* attached to the hub 610 to a second distal end 624*b*. Referring back to FIG. 6C, the portion of the lower edge 624 extending from the first end 624*a* to the second end 624*b* can be curved relative to the axis. In other embodiments, this portion of the lower edge 624 forms a straight line extending from the first end 624*a* to the second end 624*b*. The lower edge 624, when installed on the robot 700, can be substantially parallel to a floor surface. For example, the axis extending between the first and second ends 624*a*, 624*b* and the floor surface can form an angle between 85 and 90 degrees. The axis extending through the first and second ends 624*a*, 624*b* of the lower edge 624 forms an angle between 80 and 90 degrees with the rotational axis 672 of the side brush 600.

The upper edge 623 extends from a first proximal end 623*a* attached to the hub 610 to a second distal end 623*b*. The upper edge 623 extends from the hub 610 at an angle such that the distance between the lower edge 624 and the upper edge 623 of the blade 620*a* (shown on blade 620*a* in FIG. 6B) is larger as the blade 620*a* extends radially outwardly away from the hub 610. For example, a first axis between the first end 624*a* and the second end 624*b* of the lower edge 624 forms an angle with a second axis between the first end 623*a* and the second end 623*b* of the upper edge 623. This angle can be between 10 and 45 degrees (E.g., between 10 and 30 degrees, 20 and 40 degrees, 25 and 45 degrees, etc.). The portion of the upper edge 623 extending from the first end 623*a* to the second end 623*b* can be curved relative to the axis extending through the first end 623*a* and the second end 623*b*. In other embodiments, this portion of the upper edge 623 forms a straight line extending from the first end 623*a* to the second end 623*b*. Furthermore, as shown in FIG. 6C, the upper edge 623 can be offset relative to the lower edge 624 in the direction of rotation 665.

The distance from the hub 610 to the second end 623*b* of the upper edge 623 can be between, for example, 2 and 10 cm, e.g., between 2 and 3 centimeters, 2 and 5 centimeters, 2 and 7 centimeters, etc. For example, the distance between the second end 623*b* and the first end 623*a* along the rotational axis 672 is between 0.1 and 2 centimeters and the distance between the first end 623*a* and the second end 623*b* along the radial axis 670 is between 2 and 10 centimeters. In some embodiments, the second end 623*b* of the upper edge 623 may extend farther from the hub 610 than the second end 624*b* of the lower edge 624 such that the distal edge 625 (shown in FIG. 6B) of the blade 620*a* forms a non-zero angle with the rotational axis 672 of the side brush 600, e.g., an angle between 5 and 30 degrees. The second end 623*b* of the upper edge 623 can be positioned further radially outward than the second end 624*b* of the lower edge 624. The distance from the first end 623*a* to the second end 623*b* of the upper edge 623 can be, for example, 0 to 40% greater than the distance from the first end 624*a* to the second end 624*b* of the lower edge 624.

The concave surface 621 of the blade 620*a* can have a curvature profile that changes along the radial extension of the blade 620*a* from the rotational axis 672. In the example shown in FIGS. 6D-E, the blade 620*a* tapers inward from the distal end 628 to the proximal end 626. FIG. 6D illustrates a side cross-sectional view of the side brush 600 along section 6D-6D, and FIG. 6E illustrates a side cross-sectional view of the blade 620*a* along section 6E-6E. The first curvature profile of the blade 620*a* shown in FIG. 6D is larger than the second curvature profile of the blade 620*a* shown in FIG. 6E because the blade 620*a* tapers inward toward the hub 610. In embodiments, a height of the blade 620*a* at the proximal end 626 can be between 0.1 and 1 centimeters (e.g., between 0.1 and 0.3 centimeters, 0.1 and 0.5 centimeters, etc.), and a height of the blade 620*a* at the distal end 628 can be between 0.3 and 3 centimeters (e.g., between 0.3 and 1 centimeters, 0.3 and 2 centimeters, etc.). The height of the blade 620*a* at the distal end 628 can be between 25% and 200% greater than height of the blade 620*a* at the proximal end 626.

Referring also to FIG. 6C, the curvature profile of the blade 620*a* facing the direction of rotation 665 such that the concave surface 621 connects to the upper edge 623 at locations offset along the direction of rotation 665 relative to locations at which the concave surface 621 connects to the lower edge 624. The offset along the direction of rotation 665 between the upper edge 623 and the lower edge 624 at each radial distance from the hub 610 defines an overhang portion 630 of the blade 620*a*. For example, the overhang portion 630 extends from a base portion 632. In transverse cross sections of the blade 620*a*, the overhang portion 630 is curved, and the base portion 632 is straight. In the example shown in FIGS. 6D-6E, the base portion 632 forms a non-zero angle with the rotational axis 672. For example, this angle can be between 75 and 85 degrees, and the base portion 632 can extend from the lower edge 624 of the blade 620*a* in a direction opposite the direction of rotation 665.

The overhang portion 630 may vary in size along the radial extension of the blade 620*a*, as shown in the comparison between the overhang portion 630 in FIG. 6D and the overhang portion 630 in FIG. 6E of the blade 620*a*. In particular, the overhang portion 630 can decrease in size toward the hub 610. The overhang portion 630 can be between, for example, 0.1 centimeters and 1 centimeter. The overhang portion 630 of a blade 620*a* allows the blade 620 to control more precisely the debris it retrieves. For example, the overhang portion 630 may physically block debris that may experience a force imparted by the blade 620*a* as the blade 620*a* rotates. Thus instead of being flicked away from the blade 620*a*, the blade 620*a* maintains contact with the debris as the blade 620*a* rotates. The base portion 632 can contact debris, as the debris moves in response to the force imparted by the blade, the debris can move up the base portion 632 and then be blocked from losing contact with the blade 620*a* by the overhang portion 630. By maintaining contact with the debris, the blade 620*a* can more precisely guide the debris toward the cleaning head of the robot.

FIG. 7 illustrates a corner portion 707 of the robot 700. Referring to FIG. 7, similar to the side brush 400 and the side brush 800, the side brush 600 can be positioned in a corner portion 707 of the robot 700. The side brush 600 is positioned on the bottom portion 701 of the robot 700, and is rotatable about a rotational axis 672 forming a non-zero angle with the floor surface. For example, the rotational axis 672 can form an angle between 70 and 90 degrees with the floor surface, e.g., between 70 and 60 degrees, between 75 and 65 degrees, between 60 and 70 degrees, etc. As the side brush 600 rotates, the blades 620 can retrieve debris on the floor surface and move debris toward a cleaning inlet 702 (e.g., similar to the cleaning inlet 117) of the robot 700 and rotatable members 704 (e.g., similar to the rotatable members 118) of the robot 700. As the blades 620 rotate, the debris may also travel radially outwardly along the blades 620. In this regard, the debris may travel toward the distal ends of the blades 620 and toward the cleaning head of the robot 700. Further, as described in this disclosure, the overhang portion of the blades 620 can block the debris from being propelled away from the blades 620. If the debris travels upward, the overhang portion of the blades 620 can prevent the debris from traveling off of the blades 620 in an upward direction.

The side brush 600 and other blade configuration-based side brushes may vary in embodiments.

For example, the number of blades for the side brush may vary. While FIGS. 6A-7 depict the side brush 600 having two blades 620, in other embodiments, the side brush 800 may have one, three, four, five, six, or more blades 620. In some embodiments, if the side brush 600 has multiple blades, the blades 620 may be evenly spaced about the hub 610, e.g., as shown in an example of two blades 620 in FIGS. 6A-7. In other embodiments, the blades 620 are unevenly spaced about the hub 610.

The geometry of a blade 620 may also vary. In some embodiments, a blade 620 may extend from the hub 610 such that the upper edge 623 and lower edge 624 may extend at various angles from the hub 610, and the distal edge 625 may form various angles with the rotational axis 672. The upper edge 623, lower edge 624, and distal edge 625 may have various curvature profiles, e.g., one or more of the edges may arc and the curvature of the arc may vary along the radial extension of the blade 620. In some embodiments, the concave surface 621 of a blade 620 may have various curvature profiles. For example, the concave surface 621 may have zero concavity and be a flat surface.

The material of the blades may also vary in embodiments. For example, the blades 620 can be formed of different materials, e.g., metals, plastics, etc. Different portions of a blade 620 may also be formed of different materials. For example, at least part of the concave surface 621 of the blade 620 may be formed with a first material and at least part of the lower edge 624 may be formed by a second material. The lower edge 624 may be formed of a material that reduces friction between the lower edge 624 and the floor surface as the side brush 600 rotates. For example, the lower edge 624 can be formed of or lined with microfiber, polytetrafluoroethylene, or another low-friction material.

The blades 620 can include features that enhance the sweeping capability of the blades 620. In some embodiments, the blades 620 can include bristles that allow the side brush 600 to more easily engage debris and direct the debris toward the cleaning inlet 702. For example, bristles may extend from the blade 620 as part the lower edge 624 of the blade 620. The bristles can be bundled in ways described with respect to the side brush 400.

Figure 8A:
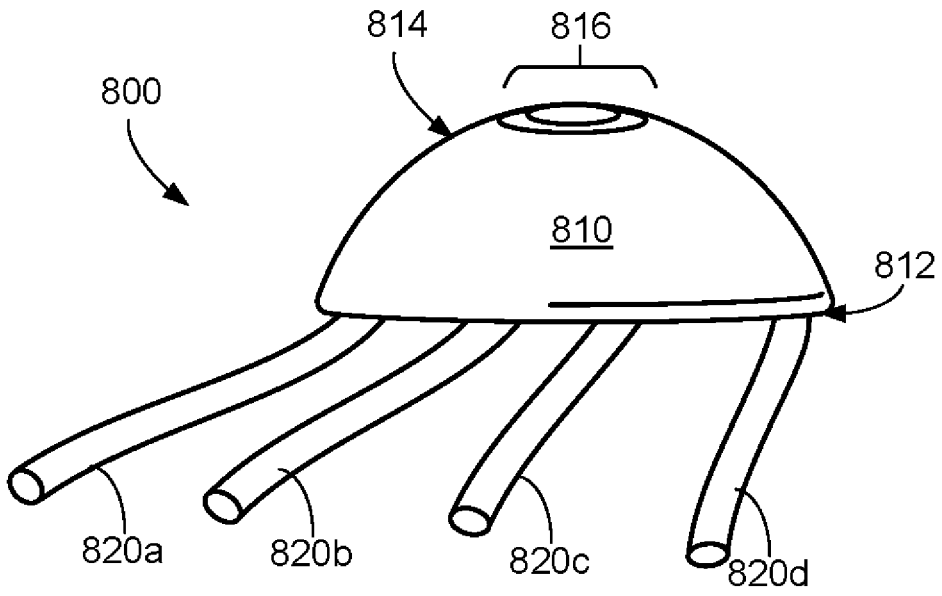
FIGS. 8A-B and D are side, perspective, and bottom views, respectively, of a side brush according to a third set of embodiments.
Figure 8B:
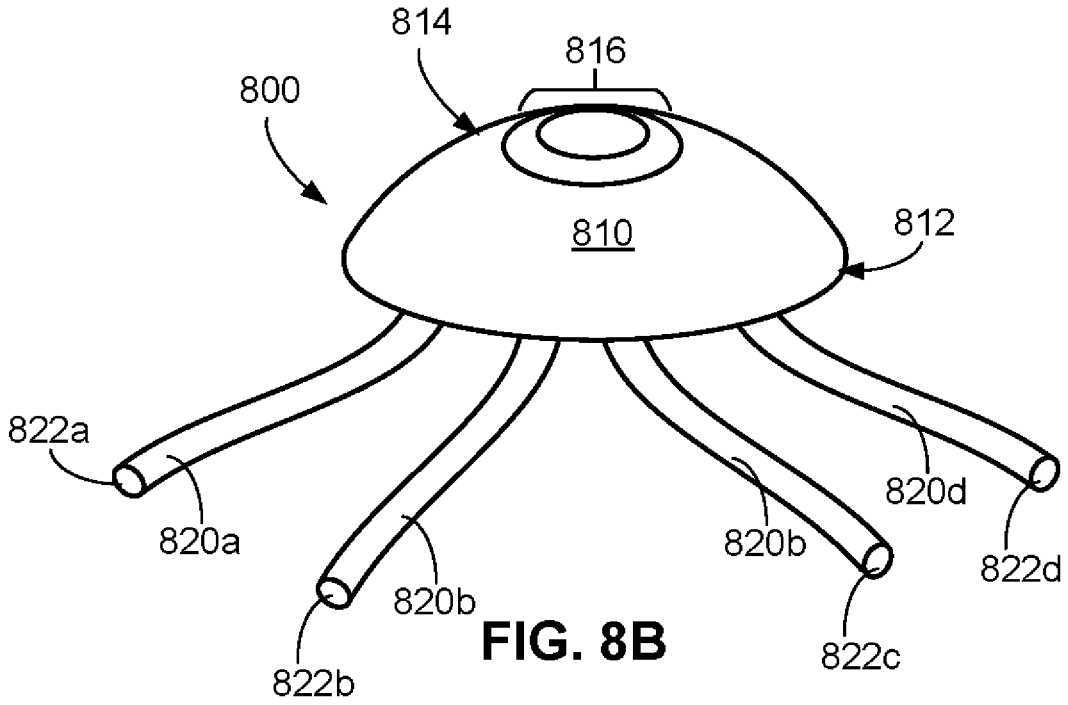
Figure 8C:
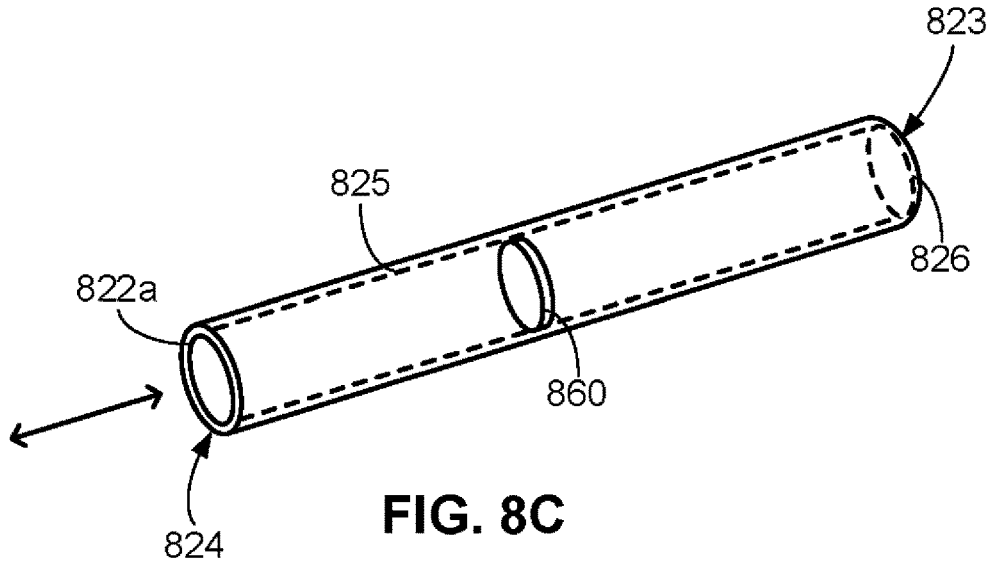
FIG. 8C is a schematic view of a tube of the side brush of FIGS. 8A-B and D.
Figure 8D:
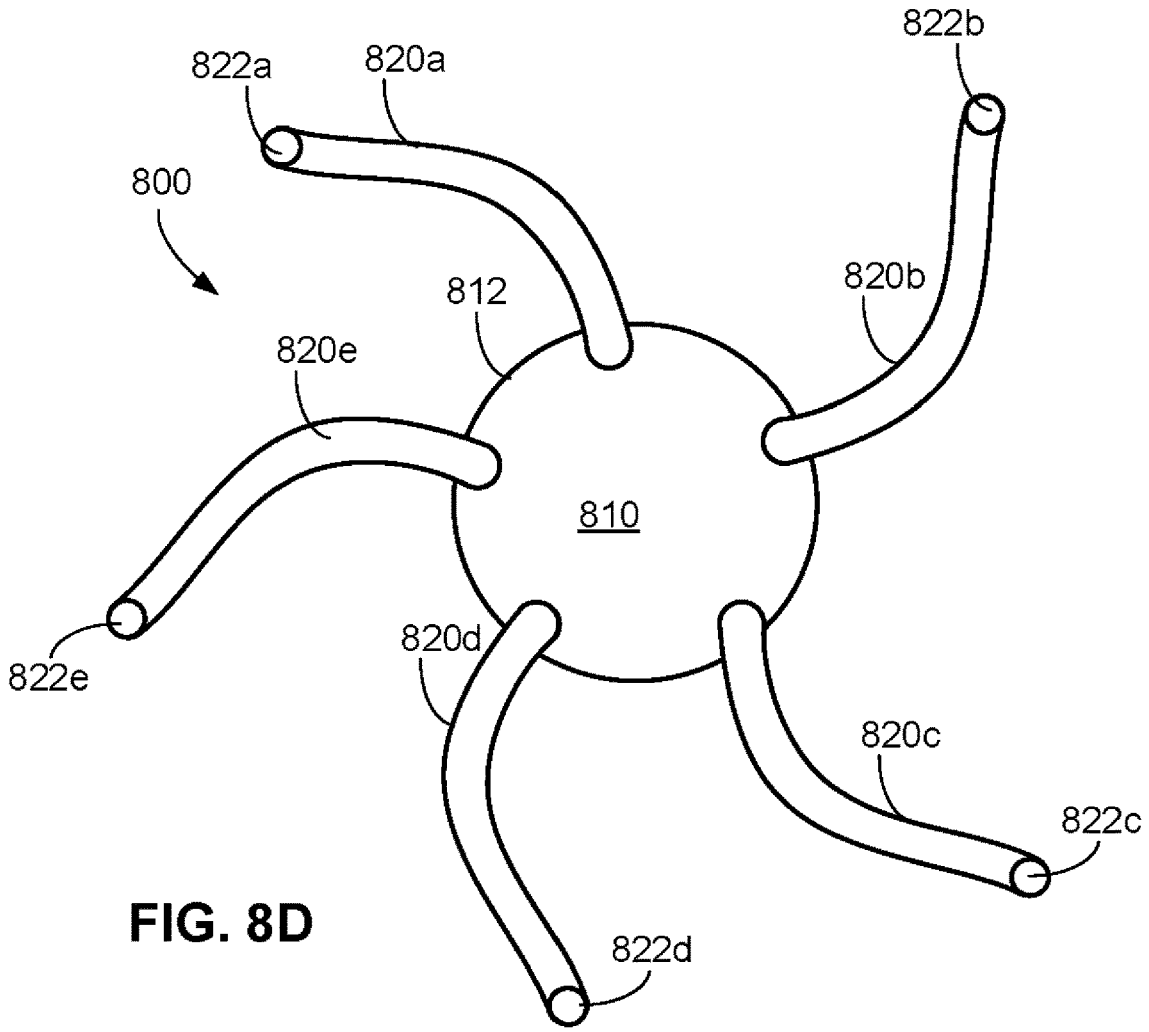
Figure 9:
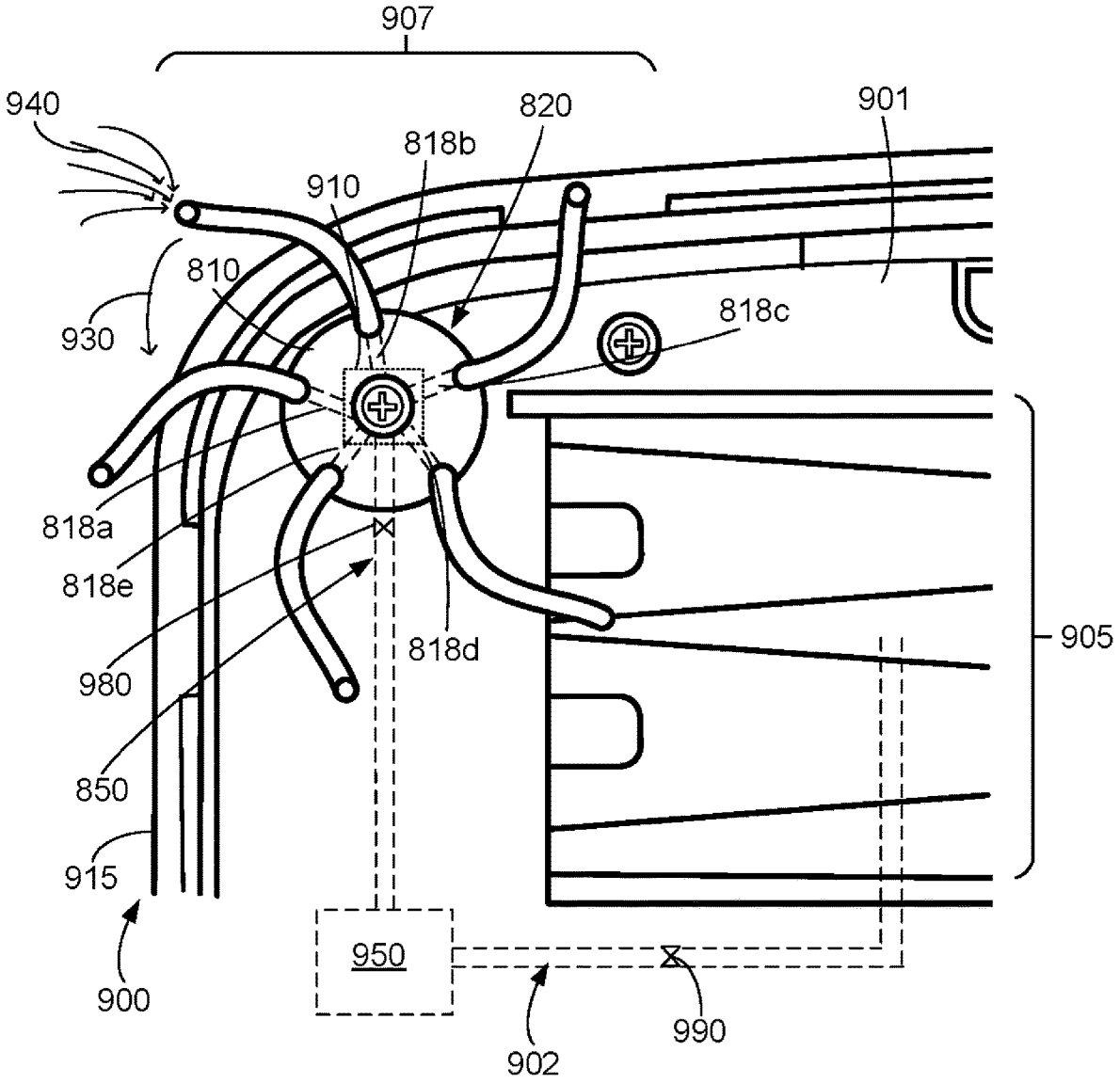
FIG. 9 is a partial bottom view of an autonomous cleaning robot with the side brush of FIGS. 8A-B and D.

FIGS. 8A-9 illustrate another example of a side brush, e.g., the side brush 800. As shown in FIGS. 8A-9, the side brush 800 includes a hub 810 and multiple arms 820*a*, 820*b*, 820*c*, 820*d*, 820*e* (collectively referred to as arms 820, and shown in FIG. 8C) extending radially outwardly from the hub 810. In this example, the side brush 800 includes five discrete arms (shown in FIG. 8C) evenly spaced about the hub 810. The side brush 800, as described in this disclosure, is capable of generating an airflow to disperse debris on the floor surface such that the debris is more easily accessible by an autonomous cleaning robot 900 (shown in FIG. 9, similar to the robot 100 with the exception of certain features associated with the side brush 800 as described in this disclosure) or to draw debris on the floor surface toward the side brush 800 such that the side brush 800 can more easily contact the debris and direct the debris toward a cleaning head 905 (shown in FIG. 9) of the robot 900. Furthermore, the side brush 800 can also be used to sweep debris on the floor surface by physically contacting the debris as the side brush 800 is rotated.

Referring to FIG. 8A, the hub 810 is rotatably mountable to the robot 900, e.g., to a bottom portion 901 of the robot 900 (shown in FIG. 9). Referring also to FIG. 9, the hub 810 can be fastened to a motor 910 (e.g., similar to the motor 152) and the actuator 910 can be operated to rotate the hub 810 and thus the side brush 800 relative to the bottom portion 901 of the robot 900. The arms 820 extend radially outwardly from the hub 810. For example, the arms 820 can be attached to a bottom portion 812 of the hub 810. In some embodiments, the arms 820 are detachable from the hub 810 such that the arms 820 can be easily replaced by a user.

The hub 810 includes an interface 816 at a top portion 814 of the hub 810. The interface 816 is a mechanical interface for engaging the hub 810 to the actuator 910 and a pneumatic interface for engaging air conduits in the hub 810 to a vacuum system 950 of the robot 100 (e.g., similar to the vacuum system 119 shown in FIG. 3A). The interface 816 engages with the actuator 910 of the robot 900 such that the actuator 910 can be driven to rotate the side brush 800, and thereby rotate the hub 810 and the arms 820. The interface 816 can further provide a pneumatic interface for the vacuum system 950 of the robot 900 to create an airflow pathway 850 between the vacuum system 950 and the arms 820. For example, the interface 816 can include one or more openings connecting the vacuum system 950 with conduits in the arms 820. For example, the interface 816 can include an opening that engages with a conduit of the robot 900, and the interface 816 can further include conduits that connect the opening in the interface 816 to the arms 820. In this regard, the interface 816 can include five conduits 818*a*-818*e* (shown in FIG. 9) that would engage with the arms 820 and that would, in particular, create a portion of the airflow pathway 850 between vacuum system 950 and the openings at the ends of the arms 820, as discussed below.

In the example shown in FIG. 8D, each of the arms 820 has a corresponding opening 822*a*, 822*b*, 822*c*, 822*d*, 822*e* (collectively referred to as openings 822). Each of the openings 822 is in pneumatic communication with the vacuum system 950 of the robot 900 for generating the airflow. The arms 820 can be shaped such that the openings 822 are at least partially directed in a horizontal direction. In this regard, airflow into the openings 822 can draw debris from positions further away from the side brush 800, and airflow away from the openings 822 to allow the airflow to disperse debris at positions further away from the side brush 800. Furthermore, the arms 820 may be angled relative to a direction of rotation, e.g., in a direction opposite to the direction of rotation.

By way of example, the arm 820*a* includes a first end 823 and a second end 824. The first end 823 is attached to the hub 810, e.g., to the bottom portion 812 of the hub 810, and the second end 824 is a free end of the arm 820*a*. FIG. 8C illustrates an example of the arm 820 isolated from the hub 810. The arm 820*a* is, for example, an elongate tubular member extending from the first end 823 to the second end 824 and has a cylindrical outer surface. The arm 820 is hollow. An interior portion of the arm 820*a* forms a conduit 825 that extends from the first end 823 to the second end 824, thereby forming a portion of the airflow pathway 850 between the openings 822 and the vacuum system 950. The conduit 825 can be a through-hole extending through a center of the arm 820*a*. An opening 826 on the second end 824 of the arm 820*a* is connectable to a corresponding opening on in the interface 816 of the hub 810, which in turn is connected to the vacuum system 950 through one or more conduits in the robot 900. The conduit 825 in the arm 820*a* forms the portion of the airflow pathway 850 between the first end 823 of the arm 820*a* and the second end 824 of the arm 820*a* and connects the opening 822 at the first end 823 of the arm 820*a* with the opening 826 at the second end 824 of the arm 820*a*.

In some embodiments, the conduit 825 has a uniform diameter through an entire length of the conduit 825. The diameter can be between 0.1 and 1 centimeter, e.g., between 0.1 and 0.5 centimeters, between 0.3 and 0.7 centimeters, between 0.5 and 0.9 centimeters, etc. A length of the arm 820*a* can be between 2 and 6 centimeters, e.g., between 2 and 4 centimeters, between 3 and 5 centimeters, between 4 and 6 centimeters, etc.

In some embodiments, the side brush 800 can include one or more filters along one or more locations along the airflow pathway 850. For example, the side brush 800 can include a filter 860 that is integral to the arm 820*a*. The filter 860 can be positioned within the conduit 825, e.g., proximate the first end 823, proximate the second end 824, or at a location toward a longitudinal center of the conduit 825. In examples in which the filter 860 is integral to the arm 820*a*, the filter 860 may be non-removable from the arm 820*a*. The arm 820*a* in its entirety—including the filter 860—can be removed from the side brush 800 and replaced to allow for replacement of the filter 860.

In examples in which the arms 820*a* has the filter 860, the filter 860 can prevent small debris and dust from clogging the airflow pathway 850. The arm 820*a*, for example, can include multiple filtering mechanisms for preventing debris from clogging the airflow pathway 850. A first filtering mechanism corresponds to the relatively small size of the conduit 825, which can prevent larger debris from entering the airflow pathway 850. A second filtering mechanism corresponds to the filter 860, which can prevent finer debris from entering the airflow pathway 850. The first filtering mechanism thus can prevent debris having a size larger than a diameter of the conduit 825 from entering the airflow pathway 850. The second filtering mechanism can prevent debris having a size larger than 0.1 to 1 millimeter from entering the airflow pathway 850. In embodiments in which the vacuum system 950 corresponds to the vacuum system for the cleaning head 905, a third filtering mechanism corresponding to a filter of the robot 100 (e.g., a high efficiency particulate air (HEPA) filter) may be present.

This disclosure describes features of the arm 820*a*. Each of the arms 820*b*, 820*c*, 820*d*, 820*e* is similar to the arm 820*a* and has features similar to those described with respect to the arm 820*a*. The arms 820*b*, 820*c*, 820*d*, 820*e* can differ from the arm 820*a* in that the arms 820*b*, 820*c*, 820*d*, 820*e* have first ends that are attached to the hub 810 at locations different from the location at which the first end 823 of arm 820*a* is attached to the hub 810. In embodiments in which the arms have individual filters, each of the arms 820*b*, 820*c*, 820*d*, 820*e* can have a corresponding filter.

Referring to FIG. 9, the robot 900 can include one or more valves that can be used to control where airflow is generated by the robot 900. For example, in the example depicted in FIG. 9, the vacuum system 950 is used to generate airflow for the side brush 800 as well as the cleaning head 905. The robot 900 can include electronically controllable valves 980, 990 that can be used to control where airflow is generated. The valve 980 is positioned in the airflow pathway 850 for the side brush 800, and the valve 990 is positioned in an airflow pathway 902 for the cleaning head 905. The valves 980, 990 are operable to be placed into open and closed positions. In embodiments, the robot 900 can control the valves 980, 990 such that (i) the valve 980 is open and the valve 990 is closed so that operation of the vacuum system 950 generates airflow through the airflow pathway 850, (ii) the valve 980 is closed and the valve 990 is open so that the operation of the vacuum system 950 generates airflow through the airflow pathway 902, or (iii) the valve 980 and the valve 990 are both open so that the operation of the vacuum system 950 generates airflow through both the airflow pathway 850 and the airflow pathway 902.

FIG. 9 illustrates a corner portion 907 of the robot 900. Referring to FIG. 9, similar to the side brush 400 and the side brush 600, the side brush 800 can be positioned in a corner portion 907 of the robot 900. The side brush 800 is positioned on the bottom portion 901 of the robot 900, and is rotatable about a rotational axis forming a non-zero angle with the floor surface. For example, the rotational axis can form an angle between 70 and 90 degrees with the floor surface, e.g., between 70 and 80 degrees, between 75 and 85 degrees, between 80 and 90 degrees, etc. The side brush 800 extends beyond an outer perimeter 915 of the bottom portion 901 of the robot 100. In particular, each of the arms 820 of the side brush 800 is positionable (e.g., rotatable in response to rotation of the side brush 800) such that at least part of the arm extends beyond the outer perimeter 915 of the bottom portion 901 of the robot 100. In this regard, each of the openings 822 of the side brush 800 and each of the first ends (e.g., the first end 823) of the arms 820 of the side brush 800 are similarly positionable beyond the perimeter 915 of the bottom portion 901 of the robot 100.

The vacuum system 950 (shown in FIG. 9) of the robot 100 can be operated to generate the airflow through the airflow pathway 850 between the openings 822 and the vacuum system 950. For example, the vacuum system 950 includes an inlet to draw air from an environment of the robot 100 and an outlet to expel air out of the robot 100 into the environment. The airflow pathway 850 includes ends at the openings 822 of the arms 820 and another end connected to the vacuum system 950 (that can correspond to the exhaust or the intake). The airflow pathway 850 is further defined by the conduits in the arms 820, the conduits in the hub 810 connected to the conduits in the arms 820, the opening at the interface 816 of the hub 810 connecting the conduits in the hub 810 to one or more conduits in the robot 100, and the one or more conduits in the robot 100 connecting the conduits in the hub 810 to the vacuum system 950.

In some embodiments, the inlet corresponds to the openings 822. The vacuum system 950 generates an airflow through the airflow pathway 850 by drawing air through the openings 822 and into the air pathway. The vacuum system 950 then expels the airflow through an exhaust of the robot 100 into the environment. In such a configuration, the airflow generated by the vacuum system 950 causes air to be drawn into the openings 822, and this air can carry debris on the floor surface toward the openings 822 and thereby toward the side brush 800.

In some embodiments, the inlet corresponds to an opening of the robot 100 distinct from the openings 822. The vacuum system 950 is configured to draw air from an environment of the robot 100, through the vacuum system 950, and out of the openings 822 of the side brush 800. The vacuum system 950 generates an airflow through the airflow pathway 850 by drawing air through the opening distinct from the openings 822 and expels the airflow through the openings 822 into the environment. In such a configuration, the airflow generated by the vacuum system 950 causes air to be expelled from the openings 822, and this air disperse debris on the floor surface. The dispersion of debris can move the debris away from portions of the floor surface where the debris would otherwise be inaccessible by the cleaning head 905, e.g., locations where the debris cannot be physically contacted by the side brush 800 or locations where the debris cannot be reached by the cleaning head 905.

In some embodiments, the vacuum system for the side brush 800 corresponds to the same vacuum system for the cleaning head of the robot 100, and in other embodiments, the vacuum system for the side brush 800 is independent of the vacuum system for the cleaning head of the robot 100. For example, in some embodiments, a single vacuum system, e.g., the vacuum system 950, is used for generating the airflow for the side brush 800 and for generating the airflow for the cleaning inlet of the cleaning head 905. In other embodiments, the vacuum system 950 for the side brush 800 can be a first vacuum system, and the robot 100 can include a second vacuum system in pneumatic communication with the cleaning inlet of the cleaning head 905.

During operation of the robot 900, the robot 900 can use the side brush 800 to sweep debris toward the cleaning head 905 and to generate airflow to disperse debris on the floor surface or to draw debris toward the side brush 800. To rotate the side brush 800, the robot 900 can selectively operate the actuator 910. The motor 910 can rotate the side brush 800 in a rotational direction 930.

To generate the airflow, the robot 900 can selectively operate the vacuum system 950. In embodiments in which the robot 900 has valves 880, 890, the robot 900 can operate selectively operate the valves 880, 890 to control whether airflow is generated for the side brush 800, the cleaning head 905, or both the side brush 800 and the cleaning head 905. Referring briefly back to FIG. 1, the robot 900 can operate the vacuum system 950 to generate the airflow to move debris 211 underneath an overhang 225 of the cabinet 220. In particular, the vacuum system 950 can generate airflow to disperse the debris 211 from underneath the overhang 225 of the cabinet 220, thereby allowing the debris to be accessed by the robot 900 (e.g., by physical contact with the side brush 800 or by the cleaning head 905), or the vacuum system 950 can generate airflow to draw the debris 211 toward the side brush 800, thereby allowing the side brush 800 to physically contact the debris 211 and direct the debris toward the cleaning head 905.

Referring back to FIG. 9, in the example shown, the side brush 800 is operated to generate airflow 940, e.g., through the airflow pathway 850, to draw debris toward the side brush 800. For example, the vacuum system 950 can be operated in a first direction with the valve 980 in the open position to generate the airflow 940 into the arms 820 of the side brush 800. The valve 990 can be in an open position or a closed position. If the valve 990 is in the open position, then airflow is also generated at the cleaning head 905 to draw debris into the cleaning head 905. If the valve 990 is in the closed position, no airflow is generated at the cleaning head 905. The vacuum system 950 can also be operated in a second direction with the valve 980 in the open position to generate airflow out of the side brush 800. If the valve 990 is in the open position, then airflow is also generated at the cleaning head 905 to expel air through the cleaning head 905. If the valve 990 is in the closed position, no airflow is generated at the cleaning head 905. During a cleaning operation of the robot 900, the robot 900 can operate the vacuum system 950 in the first direction or the second direction. In some examples, the valve 990 is only in the open position when the vacuum system 950 is operated in the first direction to draw debris into the robot 900.

In some embodiments, a sensor system of the robot 900 can detect when a portion of the floor surface is inaccessible by the robot 900. The robot 900 can include, for example, a camera (e.g., the image capture device 140 shown in FIG. 3B), and the camera can identify an obstacle that can be positioned relative to the floor surface such that part of the floor surface may accumulate debris but may be inaccessible by the robot 900. In some embodiments, the robot 900 can identify a type of the obstacle through object recognition, and the type of the obstacle can indicate that debris may accumulate under the obstacle or in spaces along the obstacle that are inaccessible by the robot 900. For example, the type of the obstacle can be a cabinet, a refrigerator, a coffee table, a shelf, a door, a stool, a desk, a cabinet, or other obstacle. In response to detecting that a portion of the floor surface is inaccessible by the robot 900, the robot 900 can actuate the valves 980, 990 so that the side brush 800 can generate airflow to disperse the debris on the inaccessible portion of the floor surface.

The side brush 800 and other vacuum system-based side brushes may vary in embodiments.

For example, the number of arms for the side brush may vary in embodiments. While FIGS. 8A-9 depict the side brush 800 having five arms 820, in other embodiments, the side brush 800 may have one, two, three, four, six, or more arms 820. In some embodiments, if the side brush 800 has multiple arms, the arms 820 may be evenly spaced about the hub 810. In other embodiments, the arms 820 are unevenly spaced about the hub 810.

The geometry of the arms 820 may also vary in embodiments. The arms 820 can include features that enhance the sweeping capability of the arms 820. For example, the arms 820 can form geometries similar to the blades of the side brush 600. In other embodiments, the arms 820 can include bristles that allow the side brush 800 to more easily engage debris and direct the debris toward the cleaning head 905. The bristles can be bundled in ways described with respect to the side brush 400.

The material of the arms may also vary in embodiments. For example, the arms 820 can be formed of a flexible polymer material.

Further Alternative Embodiments

A number of embodiments have been described. While this specification contains many specific embodiment details, these should not be construed as limitations on the scope of what is being claimed, which is defined by the claims themselves, but rather as descriptions of features that may be specific to particular embodiments of particular inventions. It will be understood that various modifications may be made.

Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially be claimed as such, one or more features from a claimed combination can in some cases be excised from the combination, and the claim may be directed to a subcombination or variation of a subcombination.

While the side brush 150 is depicted as extending beyond the forward surface 141 and the lateral side 142*a* of the robot 100, in some embodiments, the side brush 150 extends beyond only the forward surface 141 of the robot 100 or only the lateral side 142*a* of the robot 100. While the side brush 150 is shown as being positioned proximate the lateral side 142*a* of the robot 100, in some embodiments, the corner brush can be positioned instead on the lateral side 142*b* of the robot 100. For example, one of the side brushes is located proximate the lateral side 142*a*, while the other of the side brushes is located proximate the lateral side 142*b*.

While the robot 100 is depicted in FIGS. 1-3B as including a single side brush 150, in other embodiments the robot 100 includes multiple side brushes. For example, a robot 100 may comprise one, two, three, four, etc. side brushes 150. In embodiments with multiple side brushes, each side brush may be as described in this disclosure, e.g., the side brush 400, the side brush 600, the side brush 800, an alternative side brush described herein, a side brush combining features as described herein, etc., and the robot 100 may include side brushes that vary in embodiment as such.

While the robot 100 is shown and described as being substantially rectangular in its forward portion 122 and substantially semicircular in its rearward portion 121, the robot may have a perimeter that forms other shapes. For example, in some embodiments, a perimeter of the robot 100 has a square or rectangular shape. In some embodiments, a perimeter of the robot 100 has a circular shape.

While the cleaning head 170 of the robot 100 is generally described with two rotatable members 118 and a vacuum system 119, in some embodiments the robot 100 may also have zero, one, or three rotatable members, and may independently have or not have a vacuum system. For example, in some embodiments the robot 100 may have a vacuum system but no rotatable member, while in other embodiments the robot 100 may have one or more rotatable members but no vacuum system. In some embodiments a rotatable member may have bristles attached to it. The robot 100 includes a cleaning pad, e.g., a wet or dry wipe, in place of a rotatable member and a cleaning inlet. The cleaning pad may retrieve debris, and the side brush may be used to direct debris toward the cleaning pad.

While the side brushes 400, 600, and 800 are embodiments that show particular features as described herein, a side brush may have a combination of debris-manipulating components. For example, an embodiment of a side brush may include one or more bristle bundles 420, one or more blades 620, one or more vacuum tube arms 820, or a combination thereof, such that each is attached to the hub of the same side brush at various locations and as described herein independently. Furthermore, a debris-manipulating arm of the side brush may combine one or more aspects of one or more of the side brushes 400, 600, 800. In some embodiments a side brush may have, for example, one or more blades 620 with bristles 430 attached to the one or more blades, one or more bristle bundles integrated with a vacuum tube arm 820, one or more blades 620 integrated with a vacuum tube arm 820, or some other combination of the features described with respect to the side brushes 400, 600, 800.

Accordingly, other embodiments are within the scope of the claims.

What is claimed is:

1. An autonomous cleaning robot comprising:

a drive system comprising at least one drive wheel to move the autonomous cleaning robot about a floor surface;

a cleaning head on a bottom portion of the autonomous cleaning robot, the cleaning head configured to direct debris from the floor surface into the autonomous cleaning robot as the autonomous cleaning robot moves about the floor surface;

a side brush on the bottom portion of the autonomous cleaning robot, the side brush rotatable about a rotational axis forming a non-zero angle with the floor surface, and the side brush comprising an opening extending along and parallel to a plane that is sloped relative to a horizontal plane parallel to the floor surface; and a vacuum system in pneumatic communication with the opening.

2. The autonomous cleaning robot of claim 1, further comprising an air pathway between the opening of the side brush and the vacuum system, wherein the vacuum system is configured to draw air from an environment of the autonomous cleaning robot, through the opening, and into the vacuum system.

3. The autonomous cleaning robot of claim 2, wherein the side brush comprises a filter in the air pathway.

4. The autonomous cleaning robot of claim 1, further comprising an air pathway between the opening of the side brush and the vacuum system, wherein the vacuum system is configured to draw air from an environment of the autonomous cleaning robot, through the vacuum system, and through the opening to eject the air out of the opening of the side brush.

5. The autonomous cleaning robot of claim 1, wherein the side brush comprises:

a hub rotatably mounting the side brush to the bottom portion of the autonomous cleaning robot; and a plurality of arms extending outwardly from the hub and extending away from the bottom portion of the autonomous cleaning robot, wherein a distal end of an arm of the plurality of arms defines the opening.

6. The autonomous cleaning robot of claim 5, wherein the arm is hollow and formed of a flexible material, and an interior portion of the arm forms part of an air pathway between the opening of the side brush and the vacuum system.

7. The autonomous cleaning robot of claim 5, wherein the arm is detachable from the hub.

8. The autonomous cleaning robot of claim 5, wherein at least part of the arm extends beyond an outer perimeter of the bottom portion of the autonomous cleaning robot such that the distal end of the arm and the opening are positioned outside of the outer perimeter of the bottom portion of the autonomous cleaning robot.

9. The autonomous cleaning robot of claim 1, wherein the side brush comprises a plurality of openings comprising the opening, and wherein the vacuum system is in pneumatic communication with each of the plurality of openings.

10. The autonomous cleaning robot of claim 1, wherein the vacuum system is in pneumatic communication with a vacuum inlet of the cleaning head.

11. The autonomous cleaning robot of claim 1, wherein the vacuum system is a first vacuum system, and the autonomous cleaning robot comprises a second vacuum system in pneumatic communication with a vacuum inlet of the cleaning head.

12. The autonomous cleaning robot of claim 1, further comprising one or more rollers removably attached to the cleaning head, the autonomous cleaning robot being configured to rotate the one or more rollers about a roller axis that is parallel with the floor surface.

13. The autonomous cleaning robot of claim 1, wherein the opening of the side brush is at least partially directed in a horizontal direction.

14. The autonomous cleaning robot of claim 1, wherein the side brush comprises a plurality of openings comprising the opening, the vacuum system being in pneumatic communication with each opening of the plurality of openings.

15. The autonomous cleaning robot of claim 14, wherein the side brush comprises a plurality of tubes extending outward from a central portion of the side brush, and each tube of the plurality of tubes define a respective opening of the plurality of openings.

16. The autonomous cleaning robot of claim 1, wherein the side brush comprises a tube comprising the opening, at least a portion of the tube angled in a circumferential direction about the rotational axis.

17. The autonomous cleaning robot of claim 1, wherein the rotational axis is laterally offset from the cleaning head, and at least a portion of the side brush is configured to extend laterally beyond a lateral side of the autonomous cleaning robot.

18. The autonomous cleaning robot of claim 1, wherein the cleaning head comprises a vacuum inlet, and the vacuum system is configured to generate an airflow to direct the debris on the floor surface toward the side brush such that, as the side brush rotates, the side brush contacts the debris to direct the debris toward the cleaning head to cause the cleaning head to direct the debris through the vacuum inlet into the autonomous cleaning robot.

19. An autonomous cleaning robot comprising:

a drive system to move the autonomous cleaning robot about a floor surface;

a cleaning head on a bottom portion of the autonomous cleaning robot, the cleaning head configured to direct debris from the floor surface into the autonomous cleaning robot as the autonomous cleaning robot moves about the floor surface; and a side brush on the bottom portion of the autonomous cleaning robot, the side brush comprising a plurality of tubes extending outward from a central portion of the side brush that are configured to contact the floor surface, each tube defining a respective air flow channel from an opening at an end of the respective tube to the central portion of the side brush, the opening extending along and parallel to a plane that is sloped relative to a horizontal plane parallel to the floor surface.

20. The autonomous cleaning robot of claim 19, wherein each tube is configured such that the respective opening is at least partially directed in a horizontal plane.

21. The autonomous cleaning robot of claim 20, wherein the autonomous cleaning robot is configured to force air through each air flow channel of the side brush to move debris horizontally away from the side brush.

22. The autonomous cleaning robot of claim 20, wherein the autonomous cleaning robot is configured to force air through each air flow channel of the side brush to move debris horizontally toward the side brush.

23. The autonomous cleaning robot of claim 22, wherein the autonomous cleaning robot is configured to force air through each air flow channel of the side brush to move debris into the side brush.

* * * * *